US007259518B2

(12) United States Patent
Park et al.

(10) Patent No.: US 7,259,518 B2
(45) Date of Patent: Aug. 21, 2007

(54) FLAT FLUORESCENT LAMP WITH IMPROVED DISCHARGE EFFICIENCY

(75) Inventors: Deuk Il Park, Suwon-si (KR); Choong-Yop Rhew, Suwon-si (KR)

(73) Assignee: LS Tech Co. Ltd., Pyeongtaek-Si, Gyeonggi-Do (KR)

( * ) Notice: Subject to any disclaimer, the term of this patent is extended or adjusted under 35 U.S.C. 154(b) by 315 days.

(21) Appl. No.: 10/711,925

(22) Filed: Oct. 13, 2004

(65) Prior Publication Data

US 2005/0285533 A1 Dec. 29, 2005

(51) Int. Cl.
*H01J 17/16* (2006.01)

(52) U.S. Cl. ..... 313/634; 313/493

(58) Field of Classification Search ..... 313/422, 313/493, 634

See application file for complete search history.

(56) References Cited

U.S. PATENT DOCUMENTS

| | | | |
|---|---|---|---|
| 5,850,122 | A | 12/1998 | Winsor |
| 5,914,560 | A | 6/1999 | Winsor |
| 6,075,320 | A | 6/2000 | Winsor |
| 6,127,780 | A | 10/2000 | Winsor |

FOREIGN PATENT DOCUMENTS

| | | |
|---|---|---|
| JP | 2000-082441 | 3/2000 |
| KR | 10-2001-0044259 | 6/2001 |
| KR | 2001-0079377 | 8/2001 |
| KR | 10-2002-0068123 | 8/2002 |
| KR | 10-2002-0072260 | 9/2002 |
| KR | 10-2004-0004240 | 1/2004 |
| KR | 10-2004-0013020 | 2/2004 |
| KR | 10-2004-0014037 | 2/2004 |

*Primary Examiner*—Vip Patel
(74) *Attorney, Agent, or Firm*—John K. Park; Park Law Firm

(57) ABSTRACT

The present invention discloses a flat fluorescent lamp which improves discharge efficiency and luminance with an increase of a current density per discharge channel by forming multiple discharge channels of an independent serpentine layout and an exhaust channel and minimizes non-light emitting regions caused from the external electrode. The flat fluorescent lamp comprises: side walls for forming closed spaces between a front substrate and a rear substrate; partitions formed on the rear substrate and for forming multiple discharge channels of an independent serpentine layout; an exhaust channel formed on the rear substrate, connected to the respective discharge channels and used for vacuum exhaustion or discharge gas injection; and discharge electrodes arranged on both opposite ends of the starting and ending points of the multiple discharge channels of an independent serpentine layout and for discharging the discharge channels in parallel.

32 Claims, 24 Drawing Sheets

FLAT FLUORESCENT LAMP WITH IMPROVED DISCHARGE EFFICIENCY

BACKGROUND OF THE INVENTION

1. Field of the Invention

The present invention relates to a flat fluorescent lamp, and more particularly to, a flat fluorescent lamp with improved discharge efficiency which improves discharge efficiency and luminance with an increase of a current density of discharge channels by forming multiple discharge channels of an independent serpentine layout and an exhaust channel, reduces a firing potential with the enhancement of an electrode structure and eliminates non-light emitting regions caused from an external electrode with the design of electrode spaces having a width larger than the discharge channels.

2. Description of the Background Art

In a liquid crystal display (LCD), which is a passive type one of flat panel displays, a backlight unit as a light source, includes a cold cathode fluorescent lamp (CCFL), an external electrode fluorescent lamp (EEFL), an external internal electrode fluorescent lamp (EIFL), a flat fluorescent lamp (FFL), an electro luminescence (EL), a light emitting diode (LED) and the like. Among them, the CCFL is widely used in thin film transistor liquid crystal displays (TFT LCDs) since the CCFL has a long life, low power consumption, and is commercialized.

The CCFL type can be categorized into a direct type and an edge light type. Of them, the direct type CCFL is problematic in that the use of tens of lamps makes it difficult to acquire the reliability of the lamp of a liquid crystal display, and decreases the economic efficiency depending on an increase of an assembly unit cost. The edge type CCFL has a limitation in luminescence required for a large-sized liquid crystal display panel since a light is emitted from the end portions.

Therefore, the utilization of a flat fluorescent lamp (FFL) as a backlight unit is being positively examined. The flat fluorescent lamp satisfies both luminescence and lamp reliability, enhances optical efficiency and reduces the production cost of a liquid crystal display.

The flat fluorescent lamp is mostly divided into a CCFL type and an EEFL type according to the arrangement of electrodes.

Every discharge channels of the CCFL type flat fluorescent lamp is divided by a partition and extends to a serpentine layout channel. The starting region of the discharge channel is disposed in opposite of the ending region, and a phosphor layer is coated in the long discharge channel.

The above-described conventional CCFL type flat fluorescent lamp requires a high firing potential in proportion to the length of a discharge channel since it has a long discharge channel. In other words, the CCFL type flat fluorescent flat fluorescent lamp needs a high voltage of tens of kilovolts for lighting. Accordingly, the output voltage of an inverter is increased, and a power loss can be occurred due to an electromagnetic wave failure phenomenon and a leakage voltage. Therefore, in a case that the CCFL type flat fluorescent lamp is employed as a backlight unit, it is hard to use the liquid crystal display for home use.

To eliminate the above-said disadvantages, a method of dividing a discharge channel into a plurality of ones may be proposed. In this case, however, it is difficult to smoothly solve the problem of exhaustion for an individual discharge space, and there occurs an additional problem that respective inverters have to be connected to divided discharge channels, thereby increasing the manufacturing cost.

On the other hand, in the EEFL type flat fluorescent lamp, electrodes are located only on the outer parts of both ends of a glass substrate on which discharge channels are formed, and thus discharging is done within a relatively short distance as compared to the CCFL type. Hence, the EEFL type flat fluorescent lamp enables discharging even at a low voltage to achieve a stable discharging. Further, the EEFL type flat fluorescent lamp is very convenient to install electrodes.

However, the EEFL type flat fluorescent lamp has a demerit that a desired luminescence can be obtained by acquiring a wide electrode area in order to flow a sufficient current with the use of an external electrode. Thus, the dead space of the lamp becomes larger to deteriorate the outer appearance of the lamp.

Besides, in the EEFL type flat fluorescent lamp, a plurality of discharge channels in a transverse direction is embodied. Thus, there arouses a problem that an excessive power is consumed for getting a proper current density for respective discharge channels.

Further, in a case that the cross sectional area of a discharge channel is reduced for getting a proper current density in the EEFL type flat fluorescent lamp, the number of discharge channels is increased and the width of a partition is increased too. This increase of the number of discharge channels increases power consumption, and this increase of the width of a partition brings about a larger dark portion by the partition. Besides, there occurs an additional problem that the thickness of a backlight unit is increased to overcome the dark portion problem.

The present inventor has made many attempts to solve the problem of the deterioration of the efficiency of the above-described planar discharge type flat fluorescent lamp. As a result, the present inventor applied for the techniques involved with flat fluorescent lamps such as Korea Laid-Open Patent No. 2002-0072260 (Sep. 14, 2002) 'lamp assembly utilizing flat fluorescent lamp', Korean Laid-Open Patent No. 2004-14037 (Feb. 14, 2004) 'flat fluorescent lamp and lamp assembly using the same', Korea Laid-Open Patent No. 2004-0013020 (Feb. 11, 2004) 'backlight unit utilizing flat fluorescent lamp' and Korea Laid-Open Patent No. 2004-0004240 (Jan. 13, 2004) 'flat fluorescent lamp and backlight unit utilizing the same', and the present inventor suggested a method of improving the optical efficiency of a flat fluorescent lamp by enhancing the structure and arrangement of electrodes and acquiring luminance uniformity by minimizing a non-light emitting region.

With this series of research results, the present inventor devised a flat fluorescent lamp having a plurality of discharge channels of a serpentine layout and utilizing a particular exhaust channel. Further, the present inventor devised a flat fluorescent lamp with combined internal and external electrodes in order to maximize efficiency.

A fluorescent lamp utilizing a hybrid electrode was disclosed in Korea Patent Registration No. 0392181 (Jul. 8, 2003) 'discharge lamp and backlight unit employing the same'. Referring to FIG. 6 of the Korean Patent Registration No. 0392181, a CCFL type lamp having a hybrid electrode is disclosed.

Further, another fluorescent lamp employing a hybrid electrode was disclosed in Korea Patent Registration No. 0399006 (Sep. 8, 2003) 'hybrid discharge-type flat fluorescent lamp', and the Korea Patent Registration NO. 0399006 discloses a flat fluorescent lamp with combined direct current type electrode and alternating current type electrode. By this, it is possible to solve the problem that it is difficult to perform a stable discharge control at a low luminance by the control of a current of a direct current discharge type electrode having a direct current flowing since a metal electrode is exposed to a discharge space and the problem that it is difficult to achieve a high luminance due to a low current of an alternating current discharge type electrode with a dielectric layer coated on both opposite ends.

However, in case of the flat fluorescent lamp with combined direct current type internal electrode and alternating current type external electrode as shown in FIG. 6 of the Korean Patent Registration No. 0399006, discharge channels partitioned by partitions are all connected at both opposite ends, there may arouse a serious crosstalk in which every channel gathers to one channel having a relatively low firing potential. This crosstalk phenomenon is caused from the characteristic that a discharge occurs well at a region with the lowest resistance.

Subsequently, the above-described conventional technique has a restriction on the manufacture of a large-scale lamp due to the demerit that it is difficult to implement a discharge in the entire discharge channels and also has a restriction on the enhancement of optical efficiency.

SUMMARY OF THE INVENTION

The present invention is devised to adapt the hybrid electrode technique of Korea Patent Registration No. 0392181 to a flat fluorescent lamp and solve the problems of Korea Patent Registration No. 0399006.

Therefore, an object of the present invention is to provide a flat fluorescent lamp in which a discharge channel consisting of one long serpentine layout form is divided into multiple discharge channels of an independent serpentine layout, the respective discharge channels are connected by using an exhaust channel and connecting parts, electrode spaces are arranged on the starting portions and ending portions of the respective discharge channels and discharge electrodes are arranged on the electrode spaces in order to improve discharge efficiency, increase luminance and reduce a firing potential.

Another object of the present invention is to provide a flat fluorescent lamp which has discharge electrodes of an external electrode structure in order to stably discharge multiple discharge channels by a few inverters and to provide a flat fluorescent lamp which has discharge electrodes of a hybrid structure of an internal electrode and an external electrode in order to decrease non-light emitting regions of the external electrode and increase the light emission efficiency.

Yet another object of the present invention is to provide a flat fluorescent lamp in which an auxiliary electrode as well as a main discharge is formed and the auxiliary electrode is connected to the main discharge electrode to apply the same voltage or apply a power only for a while during a firing and make the auxiliary electrode floating during discharging or arranging the same in a floating electrode shape in order to reduce a firing potential of the flat fluorescent lamp and maximize the discharge efficiency.

Still another object of the present invention is to provide a flat fluorescent lamp which has an internal electrode of and internal electrode bending portions of a specific shape for obtaining the assemblability of the flat fluorescent lamp, and the reliability and stable operation of the lamp.

To achieve these and other advantages and in accordance with the purpose of the present invention, as embodied and broadly described herein, there is provided a flat fluorescent lamp, comprising: two substrates; side walls having a shape corresponding to the edges of the two substrates and forming closed spaces for discharging inside by joining to the two substrates; partitions formed on at least one surface of the two substrates and forming multiple discharge channels of an independent serpentine layout while separating the two substrates each other; and discharge electrodes arranged on electrode regions formed as channels on both opposite ends of the starting and ending points of the discharge channels of serpentine layout and for discharging the discharge channels in parallel, wherein an exhaust channel is formed independently from the discharge channels and the exhaust channel is connected to the multiple discharge channels of serpentine layout and used for vacuum exhaustion and discharge gas injection.

Here, the cross sectional area of the exhaust channel or the cross sectional area of the connecting part connecting the exhaust channel to the discharge channels can be configured to be smaller than the cross sectional area of the discharge channels.

The connecting regions of the discharge channels and the exhaust channel can be formed either at ending portions or at bending portions most adjacent to the electrodes having the same polarity in the multiple discharge channels having a serpentine layout.

The discharge electrodes can be configured by external electrodes or by hybridizing an internal electrode made of metal and an external electrode. Here, the internal electrode can be configured to form a projecting portion by bending a plate type metal.

Furthermore, the discharge electrode may further include an auxiliary electrode to be arranged at an outer part of the discharge channels in order to reduce a firing potential, and the auxiliary electrode may extend along the discharge channels from the discharge electrode in a continuous line shape. And, the auxiliary electrode can be configured to be formed along the discharge channels in a discontinuous shape and be in a floating state. And, the auxiliary electrode may be formed on the outer surface of the substrates and made of a conductive body of a transparent material.

Additionally, discharge electrodes of different polarities are applied to the electrode regions of both opposite ends of the respective discharge channels of serpentine layout, discharge electrodes of the same polarity are arranged in the same direction, and the plurality of electrode regions corresponding to at least one polarity and the exhaust channel can be configured independently from each other and can be connected to the connecting parts.

Further, discharge electrodes of different polarities are applied to the electrode regions of both opposite ends of the respective discharge channels of serpentine layout, discharge electrodes of the same polarity are arranged in the same direction, and the exhaust channel can be formed by passing through the plurality of electrode regions corresponding to at least one polarity.

And, adjacent discharge channels of snake motion layout can be formed to have a shape symmetrical to each other.

Further, discharge electrodes of different polarities are applied to the electrode regions of both opposite ends of the respective discharge channels of serpentine layout, the electrode regions connected to the same discharge channel are arrange din the same direction, adjacent discharge channels of serpentine layout have a shape symmetrical to each other, and the exhaust channel can be connected to the electrode regions of the same polarity as they are formed along the side walls.

Further, discharge electrodes of different polarities are applied to the electrode regions of both opposite ends of the respective discharge channels of serpentine layout, the electrode regions connected to the same discharge channel are arrange din the same direction, adjacent discharge channels of serpentine layout have a shape symmetrical to each other, with the polarities of the electrode regions being symmetrical, and the exhaust channel can be formed between the electrode regions of the same polarity of the discharge channels of serpentine layout.

Further, discharge electrodes of different polarities are applied to the electrode regions of both opposite ends of the respective discharge channels of serpentine layout, every electrode region is arranged in one direction, the exhaust channel is formed independently in the opposite direction of the arrangement of the electrode regions, and the exhaust channel can be connected to bending end portions of the discharge channels of serpentine layout.

Preferably, the bending portions for forming a serpentine layout of the discharge channels have the same width as other portions, and the discharge channels have a width of 3 to 15 mm and a height of 2 to 5 mm.

Moreover, the respective discharge channels can be connected in parallel and driven by using only the internal electrode in the electrode spaces and connecting a capacitive external device to the internal electrode.

Furthermore, the internal electrode is optionally used in the electrode spaces, a projecting portion can be formed on the internal electrode, and a bending portion is formed on the projecting portion so that the projecting portion can be located at the center part of the discharge channel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
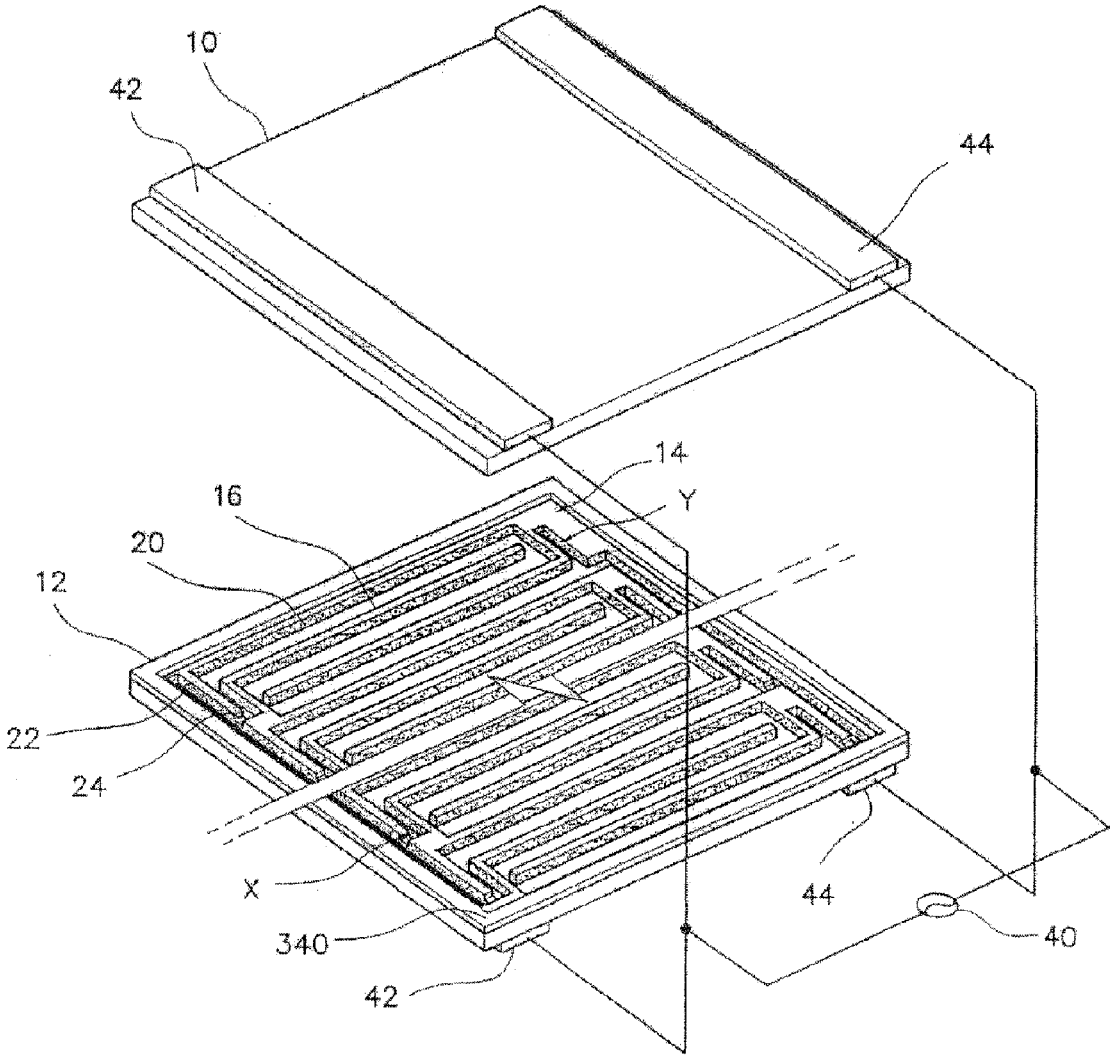
FIG. 1 is an exploded perspective view showing a preferred embodiment of a flat fluorescent lamp with improved discharge efficiency in accordance with the present invention.

Hereinafter, embodiments in accordance with the present invention will be described in detail with reference to the accompanying drawing. The same reference numerals in the drawings of the embodiments indicate members having the same functions.

As shown in FIG. 1, the flat fluorescent lamp in accordance with the present invention has a construction in which two facing substrates, i.e., a front substrate and a rear substrate 12 are conjugated to each other with side walls 14 between them. A detail construction of the rear substrate 12 is shown in FIG. 2.

Figure 2:
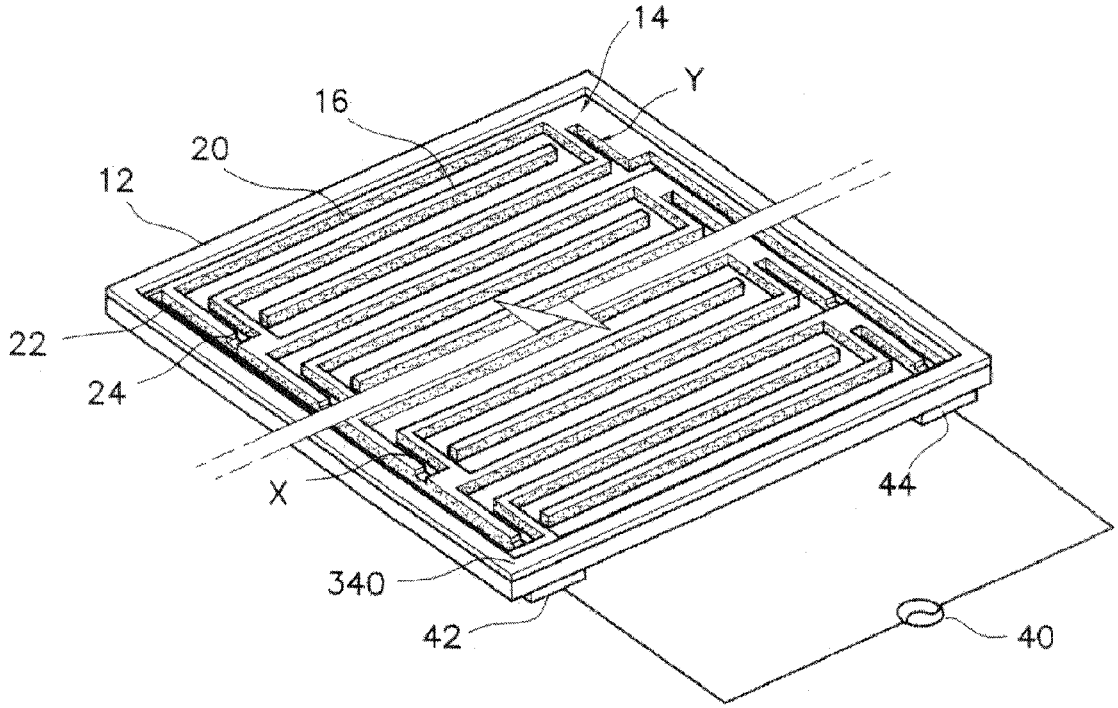
FIG. 2 is a perspective view of a rear substrate of FIG. 1.

The side wall 14 serves to block a discharge space formed between the two substrates from the outside, and can be formed integral with the rear substrate 12 as shown in FIGS. 1 and 2. In contrast, a separate member can be conjugated to the rear substrate 12 by a sealing member (for example, a low melting glass material such as flint glass).

Further, the side walls 14 can be formed separately from or integral with partitions 16 to be described later, and an example of an integral formation will be shown in FIGS. 1 and 2.

The side walls 14 formed on the rear substrate 12 can be conjugated to the front substrate 10 by a sealing member such as a low melting glass material (e.g., flint glass).

The partition 16 is formed on the rear substrate 12 of the two substrates, the substrate with the partitions 16 formed thereto is referred to as a rear substrate 12 and the other substrate is referred to as a front substrate 10 for the convenience of explanation. However, the technical idea of the present invention is not limited thereto, but may be applied in an embodiment in which partitions symmetrical to each other are formed on the front substrate 10 and the rear substrate 12 respectively.

Typically, a reflecting layer (not shown) may be coated at a lower part of the rear substrate 12. The reflecting layer is a coating material mixed with white ceramic material mainly composed of substances like $Al_2O_3$, $TiO_2$, $WO_3$ and the like. The reflecting layer functions to increase luminance by increasing the reflectance of a light generated from a fluorescent body (not shown) coated in a discharge channel 20.

The partitions 16 can be formed by processing the rear substrate 12 by sandblasting, laser machining, grinding and the like. In a different way, the partitions 16 can be produced by a method of heating and softening the rear substrate 12 and then molding the same by pressing or vacuum adsorption, or by a method of cutting a flat glass to a partition height, coating the same with a sealing flint and heating and bonding the same. Further, the partitions 16 can be produced by a method of bonding using a glass material or ceramic material extruded or pressed separately.

The embodiment shows a square shaped cross section of the partition 16, but the embodiment is not limited thereto and can be embodied in various forms including a trapezoidal shape, a semispherical shape and the like according to the intention of a manufacturer. This can be applied in various ways in consideration of the process of producing a partition 16, a manufacturer's convenience in manufacturing, a discharge phenomenon and the like.

And, as the side walls 14 and the partitions 16 are constructed on the rear substrate 12 as described above, discharge channels 20 and exhaust channels 22 are formed on the space between the side walls 14 and the partitions 16.

The discharge channels 20 have a serpentine layout in which a transverse long channel is connected by a longitudinal short channel. In a concrete embodiment, three transverse long channels are connected by a longitudinal short channel. One end of the discharge channel 20 having a serpentine layout is connected and extended to an additional longitudinal channel formed on the side wall 16, and the other end is connected and extended to another additional longitudinal channel. At this time, the respective ends of the discharge channel are formed in the opposite direction, and the channel additionally extended lengthwise to the respective ends of the discharge channel is utilized as an electrode space.

Concretely, external electrodes 42 and 44 as a transparent electrode or metal electrode are extended lengthwise to the channel region utilized as the electrode space in the outer part of the front substrate 10 and of rear substrate 12. The external electrodes 42 and 44 of the same polarity are commonly connected, and the external electrodes 42 and 44 of different polarities are configured to receive a power from a power supply unit 40.

On the other hand, the exhaust channels 22 are formed on the rear substrate 12. In the embodiment of FIGS. 1 and 2, the exhaust channel 22 are formed lengthwise adjacent to the edge parts of both longitudinal ends. Here, the exhaust channels 22 are connected through a connecting part 24 to the respective channels (electrode spaces) extended to the respective ends of a plurality of discharge channels 20 of a serpentine layout. The connecting part 24 is formed in a recess for connecting separated spaces.

The upper surface of the partition 16 is closely contacted to the front substrate 10 to serve to isolate adjacent discharge channels 20.

In a case that the cross sectional area of the discharge channel 20 is large, it is possible to prevent the occurrence of a discharge failure only by keeping the upper surface of the partition 16 and the front substrate 10 contacted to each other.

On the other hand, in a case that the cross sectional area of the discharge channel 20 is small, discharging through narrow and long discharge channels 20 becomes relatively difficult. Thus, there is a more possibility that a discharge crosstalk may occur through a fine space on the upper surface of the partition 16.

In this case, if the width of the partition 16 is increased, the problem of crosstalk occurrence can be overcome. However, in a case that the upper surface width of the partition 16 becomes larger, a non-light emitting part in the lamp is turned on upon discharging, and resultantly a dark portion is generated. To eliminate the dark portion, the distance between the lamp and a diffusion material installed on the front surface of the lamp must be further larger. In another method of overcoming crosstalk, the partition and the front substrate are heated and bonded by applying a sealing material (flint glass) or the like also to the upper surface of the partition, thereby completely preventing a discharge crosstalk through the upper surface of the partition.

In the present invention, the discharge channels 20 and the exhaust channels 22 are formed as described above. Especially, in the discharge channels 20, which are the spaces between the partitions 16, collected are multiple discharge channels in which several discharge lines of respective multiple serpentine layout are serially connected zigzag integral to one another as described above.

As seen from the present invention, since the discharge channels 20 are constructed of multiple short serpentine layout separated each other, an over discharge voltage phenomenon can be effectively controlled as much as a change in channel length, as compared to a discharge channel of one lone serpentine layout formed in the conventional art.

For example, in case of using serpentine layout discharge channels in which 30 vertical lines are connected zigzag in a transverse direction, the distance between both end electrodes are no less than 30 times the transverse length. On the other hand, in case of serially connecting vertical lines by threes and separating the lines into 10 separate short serpentine layout shape forms, the distance between both end electrodes becomes three times the transverse length, whereby the firing potential in proportion to the distance between the electrodes can be decreased to almost a 1/10 level.

Meanwhile, the exhaust channels 22 are formed on the side walls 14 for smooth exhaustion and discharge gas injection of the separated discharge channels 20. The discharge channels 20 independently isolated from one another are connected to the exhaust channels 22 through corresponding connecting parts 24, thereby making exhaustion and discharge gas injection easier.

At this time, the orthogonal cross section are of the exhaust channels 22 or of the connecting parts 24 should be relatively smaller than the orthogonal cross sectional area of the discharge channels 20. This is for minimizing the possibility that discharging through the exhaust channels 22 may occur.

Electrode spaces consistent with the starting parts and ending parts of the respective discharge channels are formed as channels on the side walls 14, and external electrodes may be arranged on the outer parts of the electrode spaces.

In this case, since a current is kept constant in the discharge channels 20 of the external electrode 42 and 44 regions due to a dielectric barrier caused from the substrate, there arouse no phenomenon that a current congests to a specific channel. That is, since a plurality of channels is discharged uniformly throughout the entire areas only by a single inverter (corresponding to the power supply unit 40 of FIG. 1), a stable light emission can be acquired and the unit cost of a circuit can be reduced.

Further, by making the width of the electrode spaces larger than the width of the discharge channels 20, the length of the electrode spaces is reduced relative to that of the discharge channels 20 while having the same area as the discharge channels 20, thereby decreasing a non-light emitting region.

Figure 12:
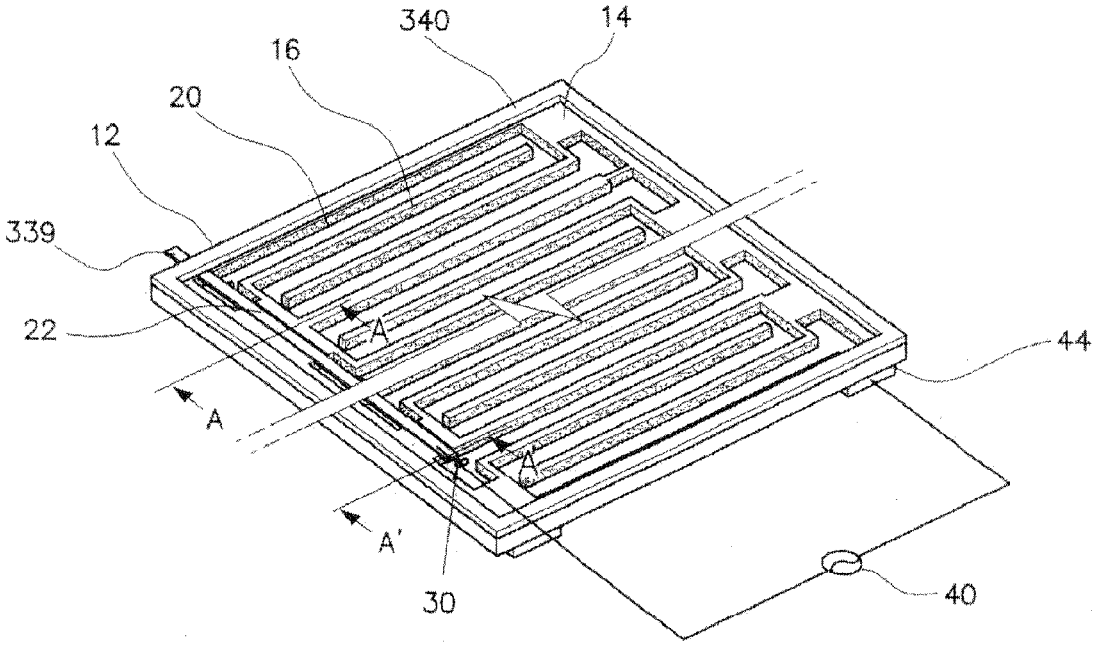
FIGS. 12 to 19 are plane layout charts and perspective views explaining the formation of discharge channels and an exhaust channel.

As shown in FIG. 12, the external electrode 44 and the internal electrode 30 are able to be hybrid constructed and used in the electrode spaces. In this case, due to the electron emission effect of metal electrodes, the firing potential becomes smaller and the discharge efficiency is enhanced.

Conventionally, in case of discharging a dielectric barrier utilizing an external electrode, the area of the electrode surrounding the discharge space acts as an important factor in controlling a discharge current. In the event that the discharge channel becomes narrow, the area of the electrode is also decreased to fail to obtain a proper current, and resultantly fail to obtain a desired current density value, thereby deteriorating the light emission efficiency.

However, in case of hybridizing the internal electrode and the external electrode as shown in the present invention, even if the external electrode having the same area as the internal electrode is used, a capacitance two time larger can be acquired and thus a current two times larger can be made flown in the external electrode, thereby increasing the luminance of the lamp too. Further, in case of making a current of the same quantity flown, it is possible to reduce the area of the external electrode to half. Resultantly, due to the hybrid electrode of the fluorescent lamp in accordance with the present invention, the light emission efficiency is increased and the area of a non-light emitting region is decreased.

Further, it is also possible to use only every internal electrode in the electrode space and connect respective discharge channels to capacitive devices in the outer part of the flat lamp and parallel connecting and driving them.

In this case, the current of the respective discharge channels 20 is restricted to a constant level by the capacitive devices, thus a discharge nonuniformity phenomenon where only several channels are discharged can be eliminated, thereby enabling the lamp stably parallel driven. In this case, the parts of the internal electrode and capacitor are increased. Thus, even if the number of parts is increased, the discharge efficiency can be even higher by discharging using only the internal electrode.

Figure 4A:
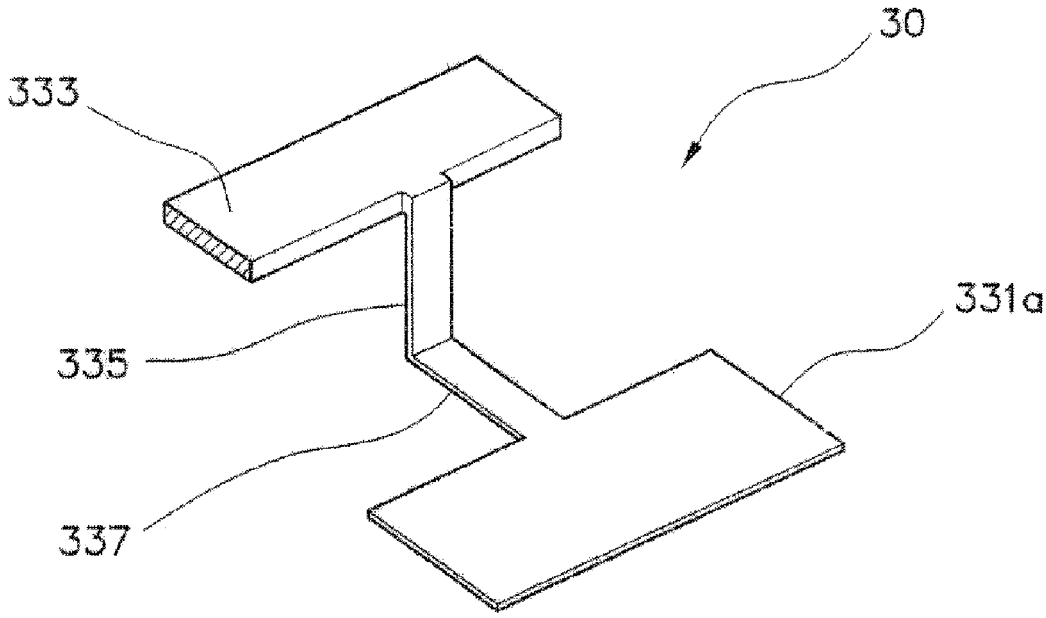
FIGS. 4*a* and 4*b* are perspective views explaining an embodiment of an internal electrode.
Figure 4B:
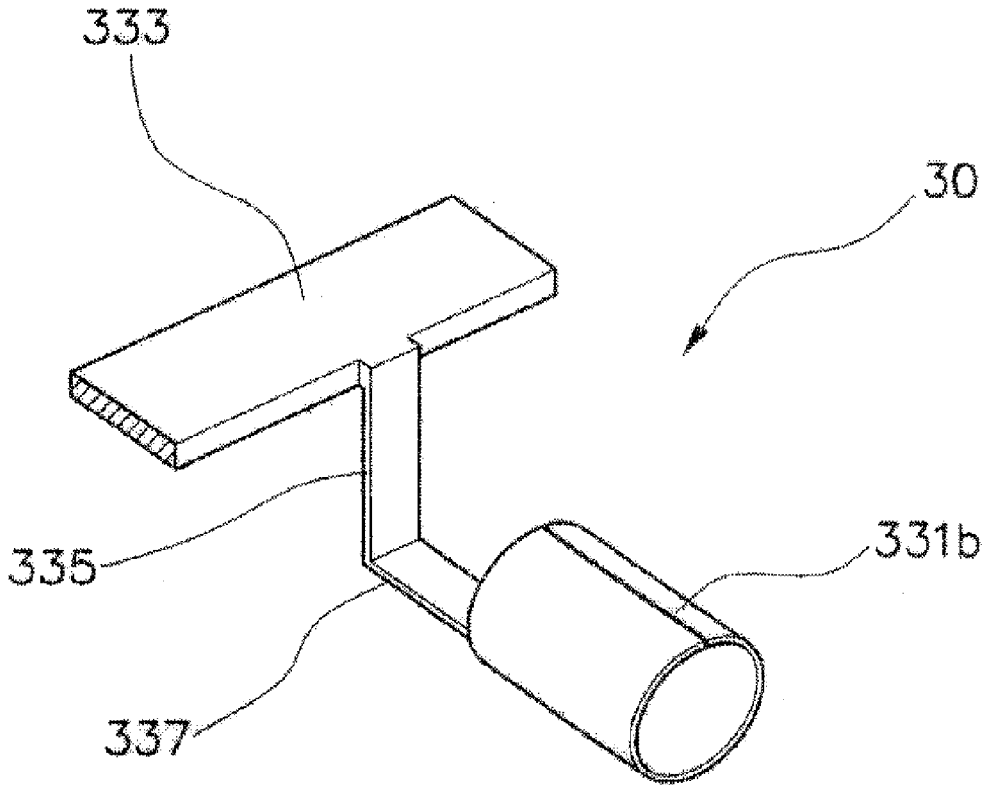

Here, as shown in FIGS. 4*a* and 4*b*, if the internal electrode has a projecting portion extending to the inside of the flat lamp, the internal electrode can induce a current to flow in the projecting portion, thereby enabling a more stable discharging.

When forming the projecting portion 337 on the internal electrode 30, it is preferable that the end 331*a* of the projecting portion 337 is located on the center portion on the cross section of the discharge channel by having a bending portion 335 on a plate type electrode 333. In this case, a heat shock of the substrate due to the heat generation of the electrode can be minimized to thus increase the reliability of the flat fluorescent lamp.

Additionally, it is preferable to enhance the reliability of the vacuum sealing of the flat lamp by making relatively smaller the width of the plate type electrode 333 located on an edge side wall member of the flat fluorescent lamp or extending the plate type electrode 333 to the outer part of the flat lamp through the exhaust channel 22 using a connecting line 339 as shown in FIG. 12 to be described later.

The projecting portion 337 can have a cylindrical end 331*b* by pressing and bending, and the mass production of electrodes can be accomplished by forming a plate type material in a continuous processing method using a metal mold, thereby drastically reducing the manufacturing cost of the flat lamp.

Figure 5A:
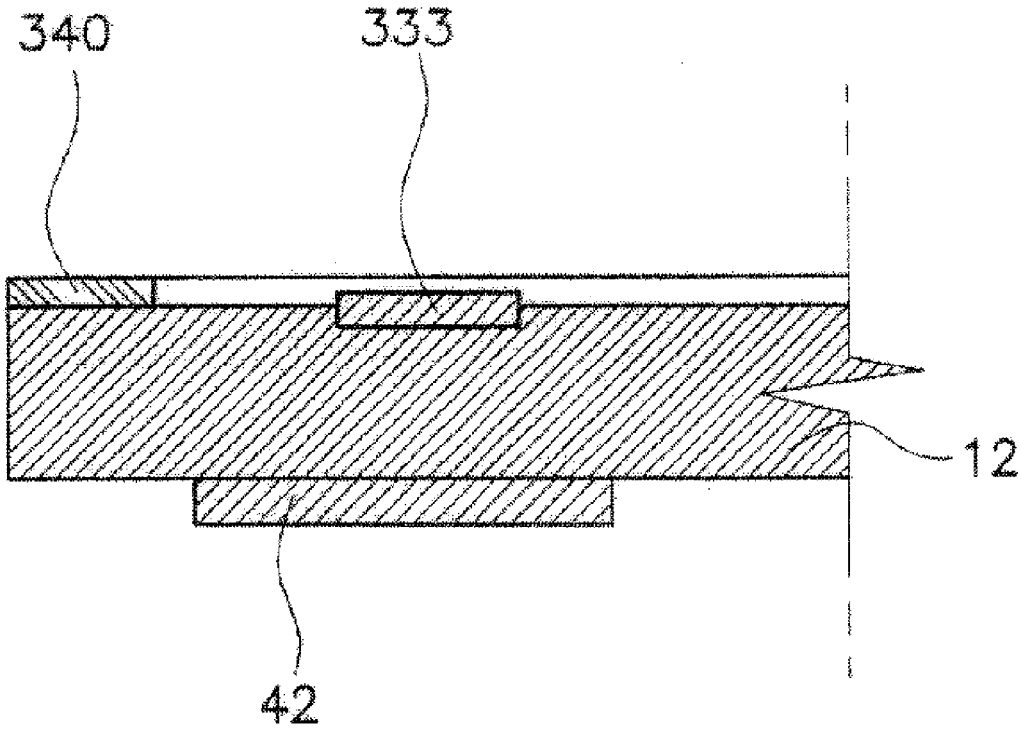
FIGS. 5*a* and 5*b* are cross sectional views explaining an example of the internal electrode arranged on a discharge channel.
Figure 5B:
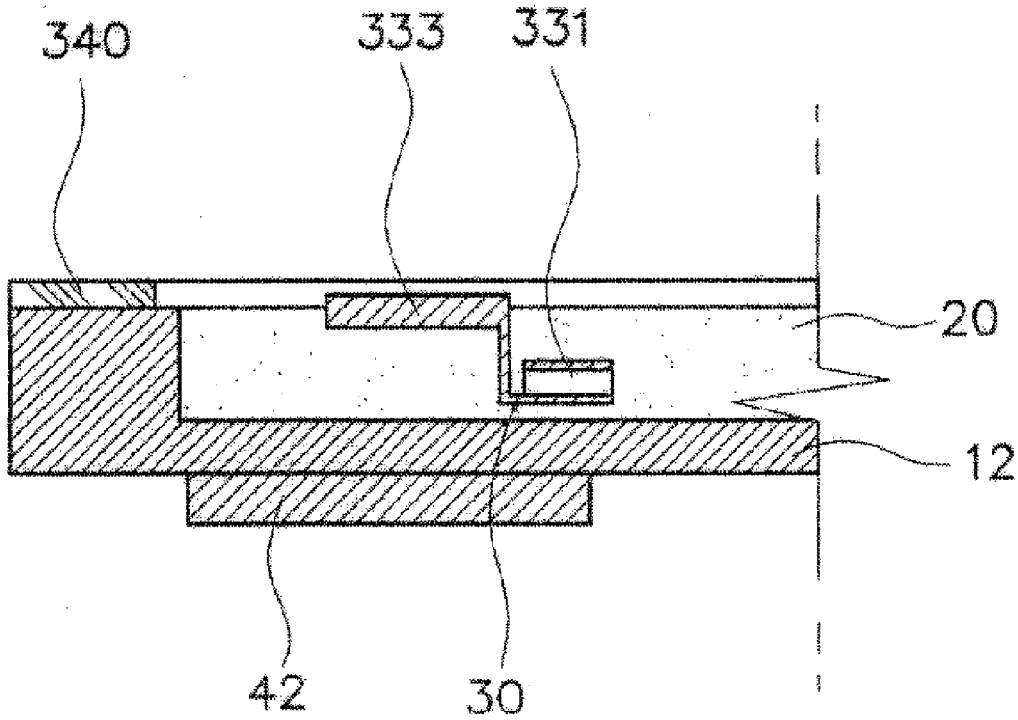

As shown in FIGS. 5*a* and 5*b*, it is preferable that the projecting portion 337 is constructed in a manner that the cylindrical end 331*b* is located at the center of the space by the bending portion of the electrode when viewed from the cross section of the discharge channels. This is because the risk that the substrate is damaged from a heat shock due to a heat generated from the internal electrode as the end of the internal electrode is contacted to the substrate upon normal discharging of the product. FIGS. 5*a* and 5*b* show the cross section of portion A and the cross section of portion A' of FIG. 12 to be described later. In FIGS. 5*a* and 5*b*, reference numeral 340 indicates flint glass for bonding the front substrate 10 and the rear substrate 12.

In the present invention, it is possible to overcome the increase of a firing potential caused by discharge channels lengthened by having main electrodes like external electrodes and internal electrodes and auxiliary electrodes formed in the outer part of the discharge channel 20. The auxiliary electrode can be a help to overcome the problem that a driving voltage is increased according to an increase of a firing potential caused from the lengthened discharge channels. This is because the distance between the discharge electrodes can be shortened through the auxiliary electrodes.

Figure 3:
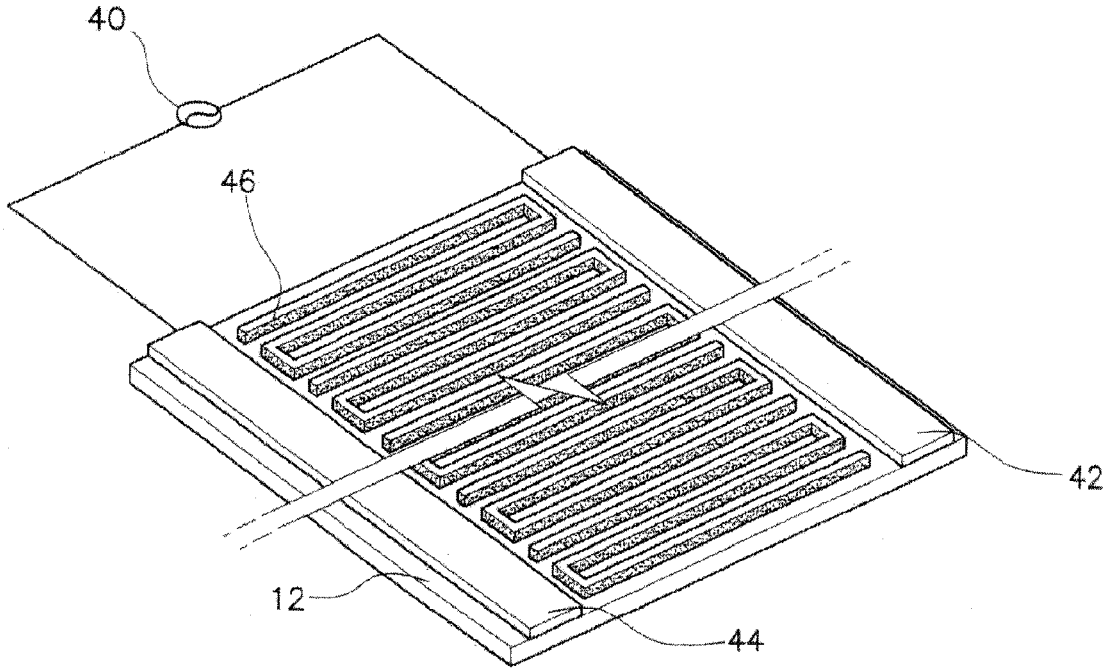
FIG. 3 is a perspective view of the bottom surface of the rear substrate of FIG. 1.

Further, in the embodiment of FIGS. 1 and 2, the bottom surface of the rear substrate 12 can be constructed as shown in FIG. 3, the external electrodes 42 and 44 are formed in a longitudinal direction so as to correspond to the electrode spaces, and the auxiliary electrodes 46 are formed between the external electrodes 42 and 44 so that they can have a cross section of a hexahedron and be floating narrow and long while having a serpentine layout shape corresponding to the region where the discharge channels 20 having a serpentine layout shape are located.

Further, the auxiliary electrodes can be deformed variously on the bottom surface of the rear substrate 12 as shown in FIGS. 6 to 11. The embodiment of the auxiliary electrodes of FIGS. 6 to 11 shows an example of embodying auxiliary electrodes in discharge channels of a different shape from those in FIGS. 1 to 3.

In the embodiment of FIGS. 6 to 9, discharge electrodes X and Y are arranged in the same direction. And, a discharge channel 20 of a serpentine layout connecting these discharge electrodes includes 4 longitudinal channels, and bending portions connecting the longitudinal channels are formed on the opposite side where the discharge electrodes X and Y are formed.

The auxiliary electrodes 46 can be embodied on the discharge channel in various forms as shown in FIGS. 6 to 9.

Figure 6:
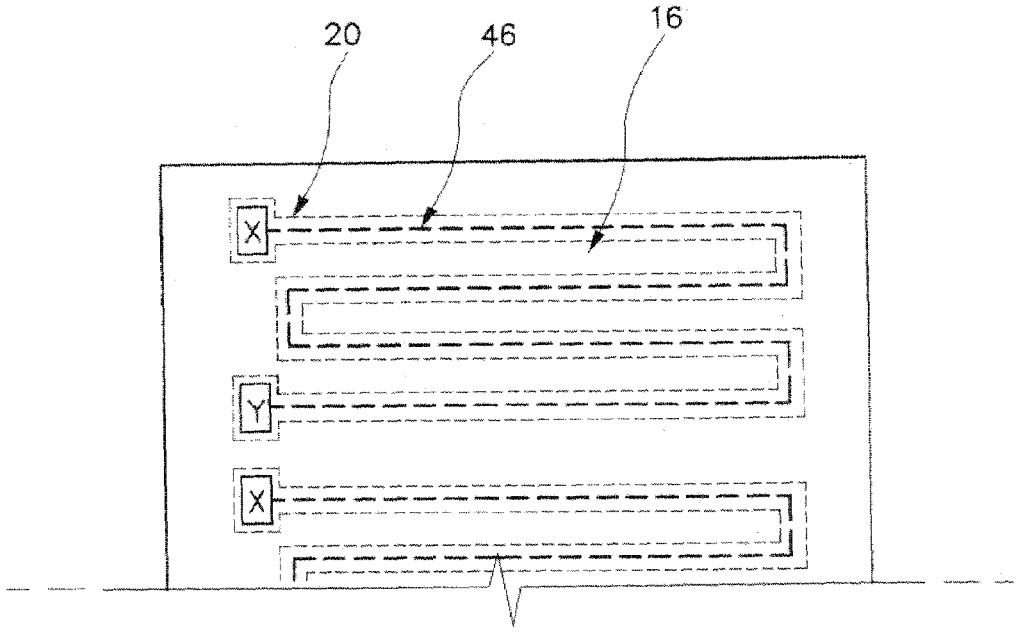
FIGS. 6 to 11 are plane layout charts explaining the arrangement of an auxiliary electrode in accordance with the present invention.
Figure 7:
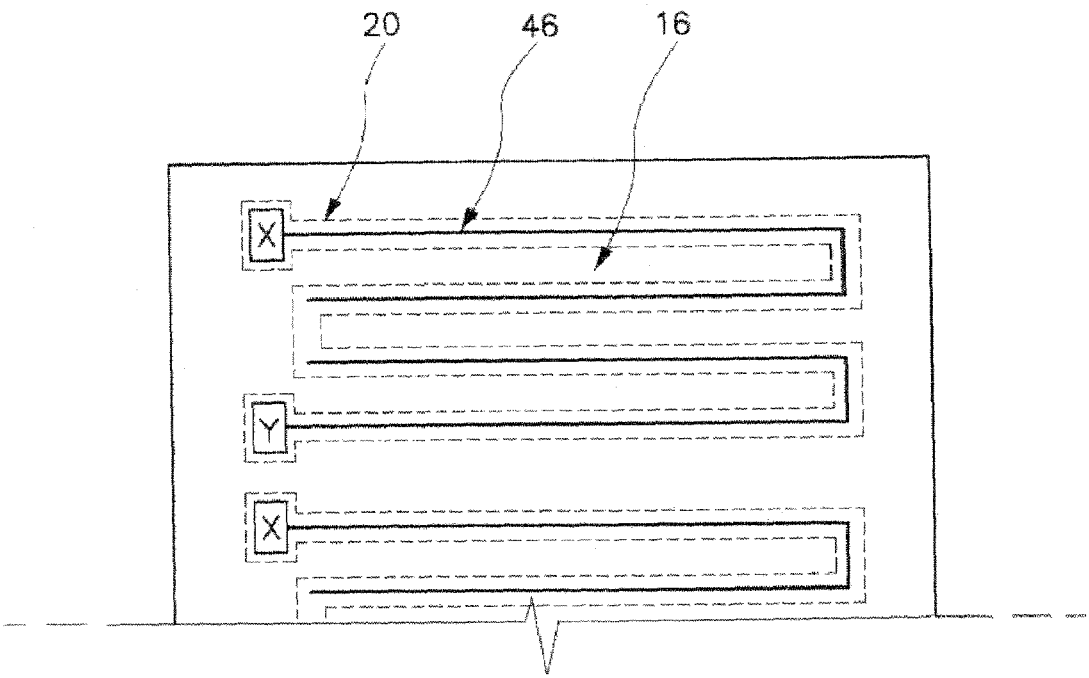
Figure 8:
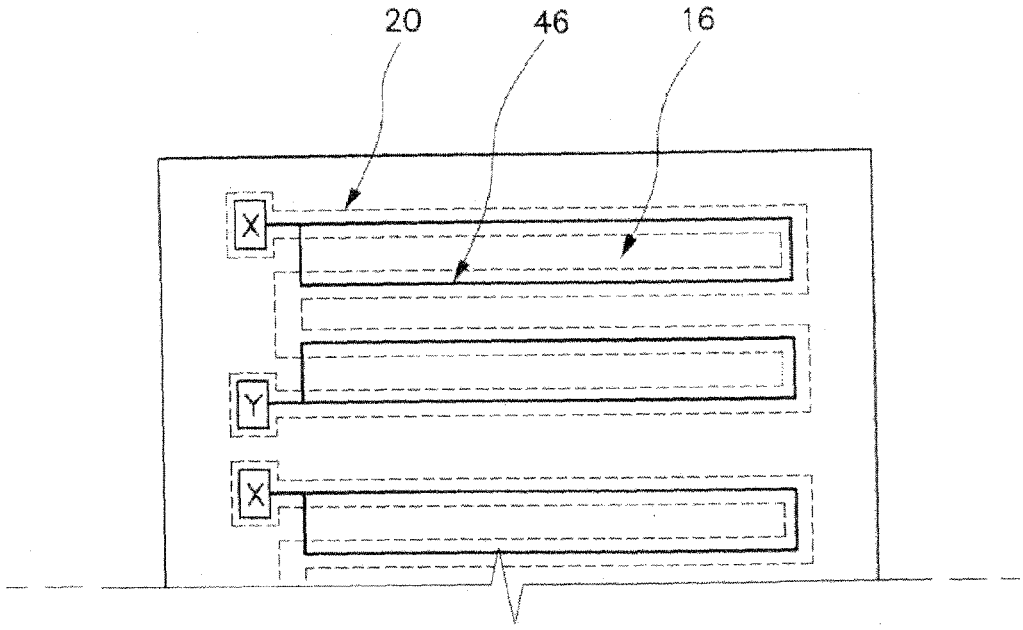
Figure 9:
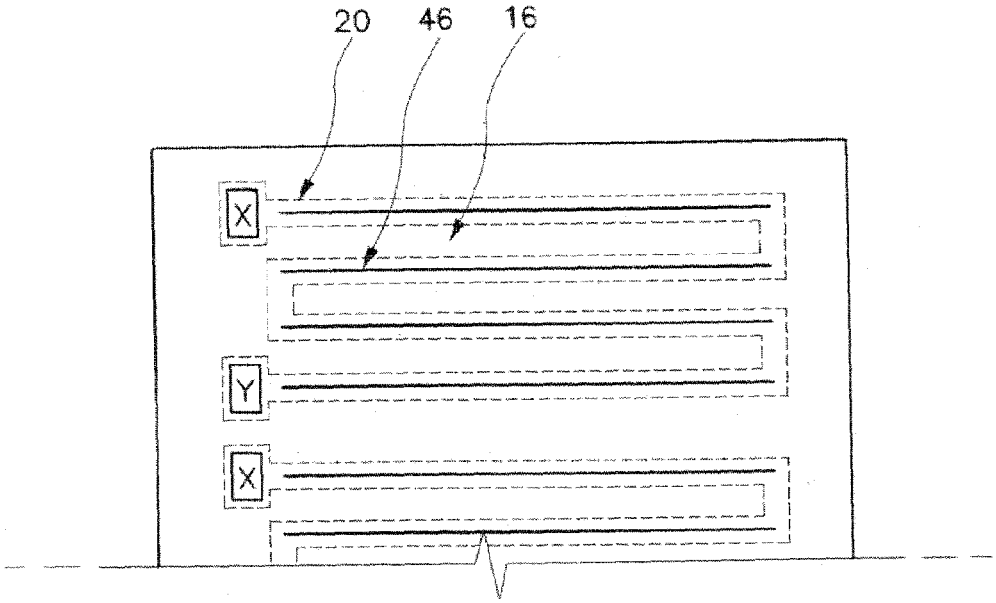

In FIGS. 6 to 9, the embodiment shows an example of arranging the channel forming electrode space portions in the same direction and forming auxiliary electrodes 46 relative to a discharge channel 20 of a serpentine layout having bending portions. In the embodiment of FIG. 6, the auxiliary electrodes 46 are formed in a manner to be floating in discontinuous dot line along the discharge channel 20 between the two electrode spaces of different polarities. In the embodiment of FIG. 7, the auxiliary electrodes 46 are formed in a manner to extend from the respective electrodes along the discharge channel 20 between the two electrode spaces of different polarities and have the same potential as the electrodes. In the embodiment of FIG. 8, the auxiliary electrodes 46 are formed in a manner to extend along the discharge channel 20 between the two electrode spaces of different polarities, form a closed loop at the middle part of the discharge channel 20 and have the same potential as the electrodes. In the embodiment of FIG. 9, the auxiliary electrodes 46 are formed in a manner to be arranged in real line along the lines of the discharge channel 20 and be floating.

In FIGS. 6 to 9, reference numeral 16 represents a partition.

Figure 10:
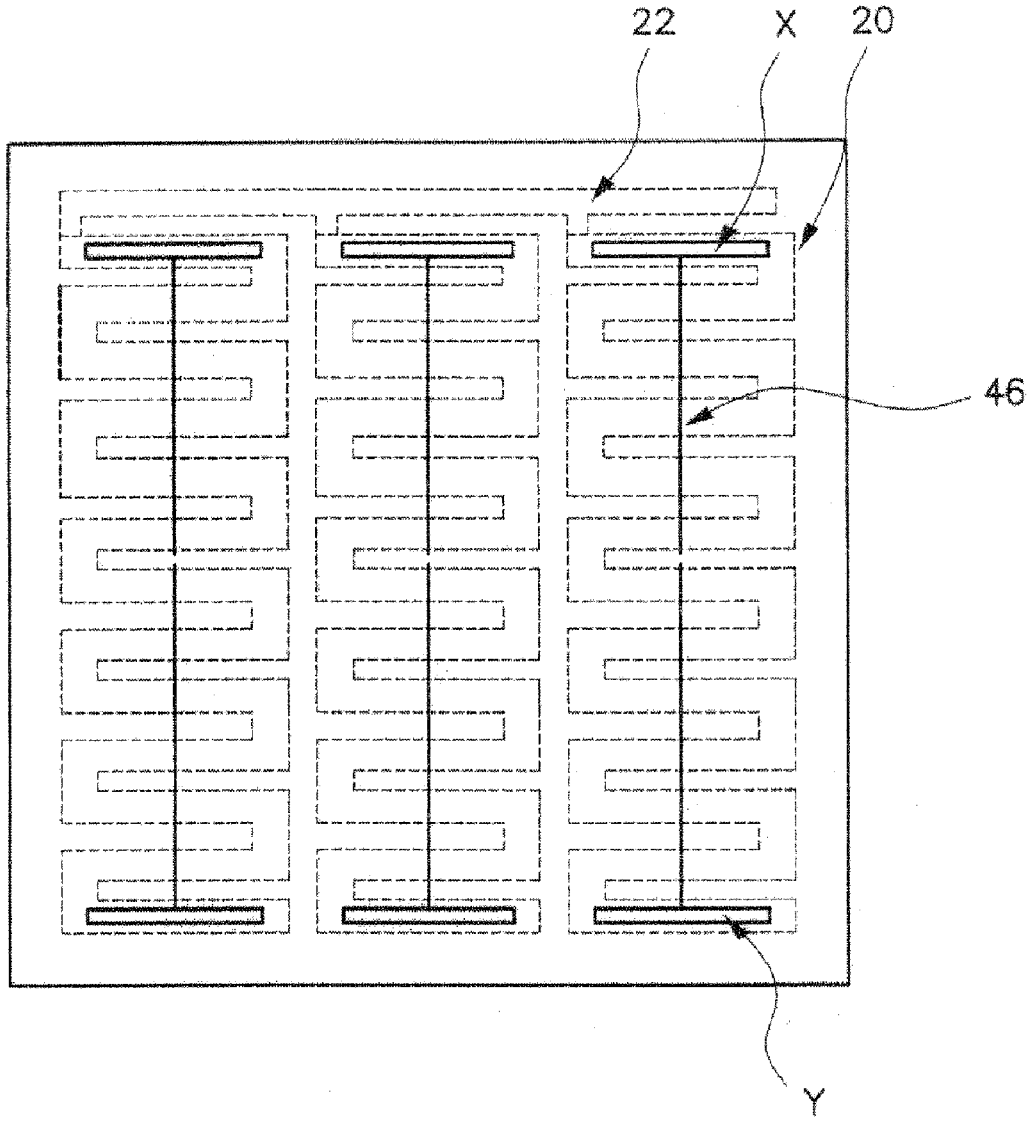
Figure 11:
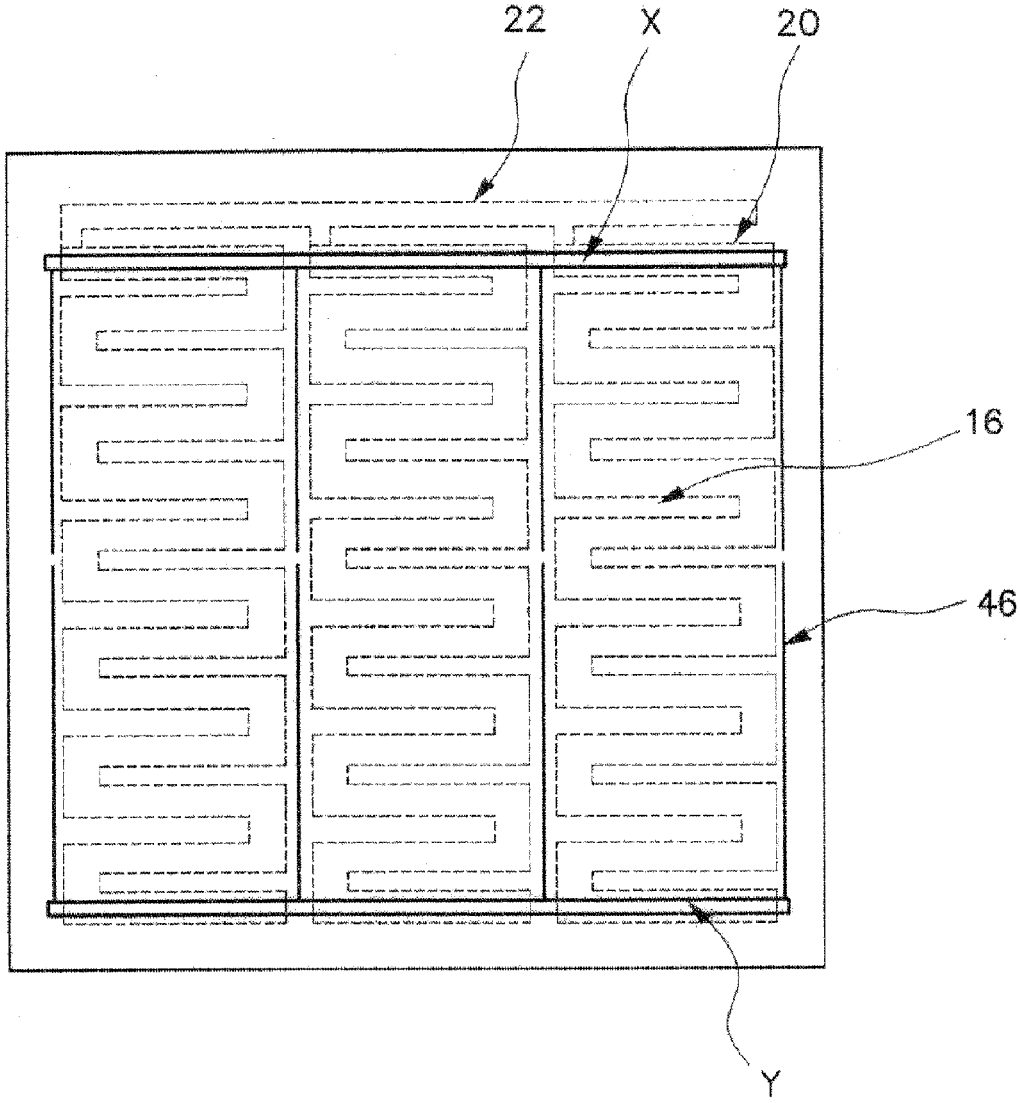

FIGS. 10 and 11 shows an example of arranging auxiliary electrodes in a lamp having a discharge channel structure in which discharge channels of a serpentine layout formed in a longitudinal direction are arranged in a transverse direction.

In FIG. 10, discharge electrodes of X and Y poles are arranged on the tips of discharge channels 20 at both upper and lower ends, and the auxiliary electrodes 46 extend in real line from the respective electrodes in a manner to cross the serpentine layout discharge channel toward the middle part of the lamp. Here, the electrodes X and Y are configured to be divided in independent serpentine layout units.

In FIG. 11, discharge electrodes of X and Y poles are arranged on the tips of discharge channels 20 at both upper and lower ends, and the auxiliary electrodes 46 extend in real line to ward the middle part of the lamp and arranged through the upper end of a longitudinal partition 16 isolating the discharge channels. Here, the electrodes X and Y are configured to extend so as to be overlapped with the ends of the entire serpentine layout.

As stated above, by means of the auxiliary electrodes 46 embodied in various forms as shown in FIGS. 6 and 11, discharging between the main discharge electrodes is carried out after predischarging is firstly generated between the auxiliary electrodes 46 and the electrodes. Thus, a voltage drop effect by the auxiliary electrodes can be obtained and, at the same time, the discharge efficiency of the main discharge electrodes can be larger.

If the width of the auxiliary electrode 46 is too large, a discharge current through the auxiliary electrode 46 increases to increase a power consumption, and acts as a factor of deteriorating the luminance of the flat fluorescent lamp. Moreover, discharging through the main discharge electrode should be carried out mainly so that a relatively long plasma post can be formed and the discharge efficiency can be increased. Therefore, if the auxiliary electrode consumes a lot of current, the discharge efficiency is decreased.

On the contrary, if the width of the auxiliary electrode 46 is too small, the effect of voltage application is reduced. Thus, it is preferred to maintain a proper width.

As shown in FIGS. 6 to 11, the auxiliary electrode 46 can be installed by extending it from the main discharge electrode along the discharge space and arranging it in a continuous line, or by arranging it in a discontinuous shape and floating it, or by arranging it in real line for separating it from the main discharge electrode and then floating it, or by applying a power only for a predetermined period of time during discharging and then floating it again.

In a case of installing the auxiliary electrode 46 at an outer part of the front substrate, it is preferable to prevent the deterioration of light transmittance using a transparent conductive body such as an ITO in order to prevent the deterioration of light transmittance due to the electrodes and a resultant loss of luminance.

In the manufacture of the lamp in accordance with the present invention, the external electrode can b formed by printing with a metallic paste material and then drying and baking, or by directly attaching a metallic tape material.

The internal electrode 30 is mounted in the lamp as shown in FIG. 12, and then the front substrate and a side wall are sealed using a low melting glass (e.g., flint glass), which is a sealing member. Next, the inner part of the lamp is made vacuum through an exhaustion process using an exhaust pipe (not shown) extended to an exhaust channel, is filled with a discharge gas (rare gas such as Ar, Ne, Xe, etc., or Hg), and then the exhaust pipe is fusion-welded to prepare a lamp.

Preferably, in accordance with the present invention, the width of the discharge channel 20 between the partitions is 3 to 15 mm and the height thereof is 2 to 5 mm.

If the cross sectional area of the discharge channel 20 is too small, the driving voltage increases and discharging becomes unstable. On the contrary, if the cross sectional area is too large, the driving voltage becomes lower but discharge plasma is not formed throughout the entire regions of the channel section but is partially formed. Due to this, a fluorescent body light emission does not occur throughout the entire discharge channels and thus partially dark regions are produced.

Further, it is preferable that the longitudinal channel width of the bending portion connecting the discharge lines of the discharge channel 20 are the same as the transverse channel width thereof. This is because discharging hardly occurs on a narrow region.

A fluorescent layer (not shown) is coated on the partition 16 and the bottom surface of the rear substrate 12. The fluorescent layer is made by mixing green, blue and red light emitting elements based on a chromaticity diagram to prepare a white fluorescent body, mixing it with an organic resin, applies the mixture at a predetermined thickness, baking it and then coating it.

Meanwhile, the arrangement of the discharge channel and the exhaust channel constituting the core part of the present invention can be embodied in various forms.

That is, a method of placing an exhaust channel completely independent from a discharge channel and connecting it to the discharge channel using a connecting part, a method of using parts of the discharge channel as an exhaust channel and connecting the discharge channel to the exhaust channel using a connecting part, a method of connecting an exhaust channel using a space between a discharge channel and an adjacent discharge channel, etc. are available.

A discharge channel of a serpentine layout can have a cup ('C' type) shape whose one side is opened with two lines joined, or can have a shape in which three lines are joined. Besides, connection of more than three lines is also possible.

Regarding the polarities of discharge electrodes, when bipolarities of a potential applied to the electrodes are named X and Y respectively, the discharge electrodes can be arranged alternatively in the order of X, Y, X, Y, X and Y in the respective discharge channel, or can be arranged in the order of X, Y, Y, X, X, Y, Y and X.

At this time, in a case that the number of bending portions forming the discharge channel of serpentine layout is even, i.e., in a case that an odd number of lines are connected and used as a single discharge channel, the starting point and ending point of the respective discharge channel can be arranged separately at the left and right side ends of the substrate.

For example, if it is assumed that 10 independent type discharge channels each having three long transverse channels connected are formed, the starting points of the first to tenth discharge channels can be all arranged at the left side of the substrate and the ending points thereof can be arranged at the right side of the substrate. At this time, when arranging electrodes, the left starting points of the substrate can be all used as X electrode spaces and the right ending points thereof can be all used as Y electrode spaces. Thus, this can be carried out in a very simple way when connecting power lines hereafter. Accordingly, it is preferred to connect an odd number of lines and use them as a single discharge channel for making smooth the arrangement of electrodes.

Figure 20:
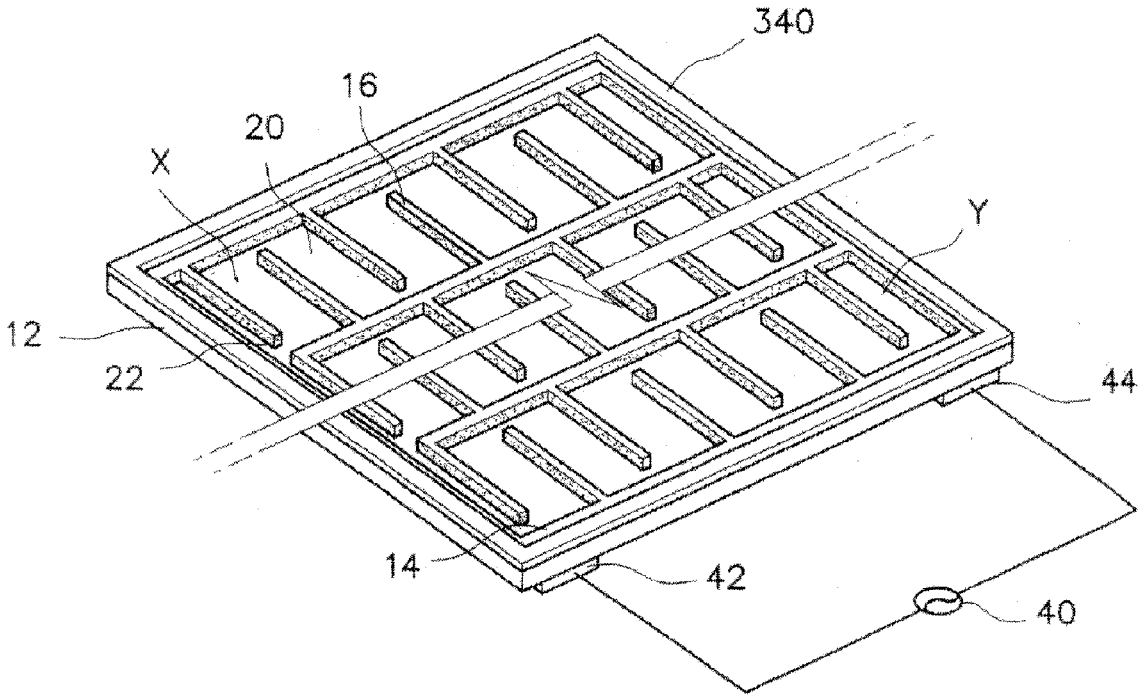
FIGS. 20 to 22 are perspective views explaining another embodiment of discharge channels and an exhaust channel in accordance with the present invention.
Figure 21:
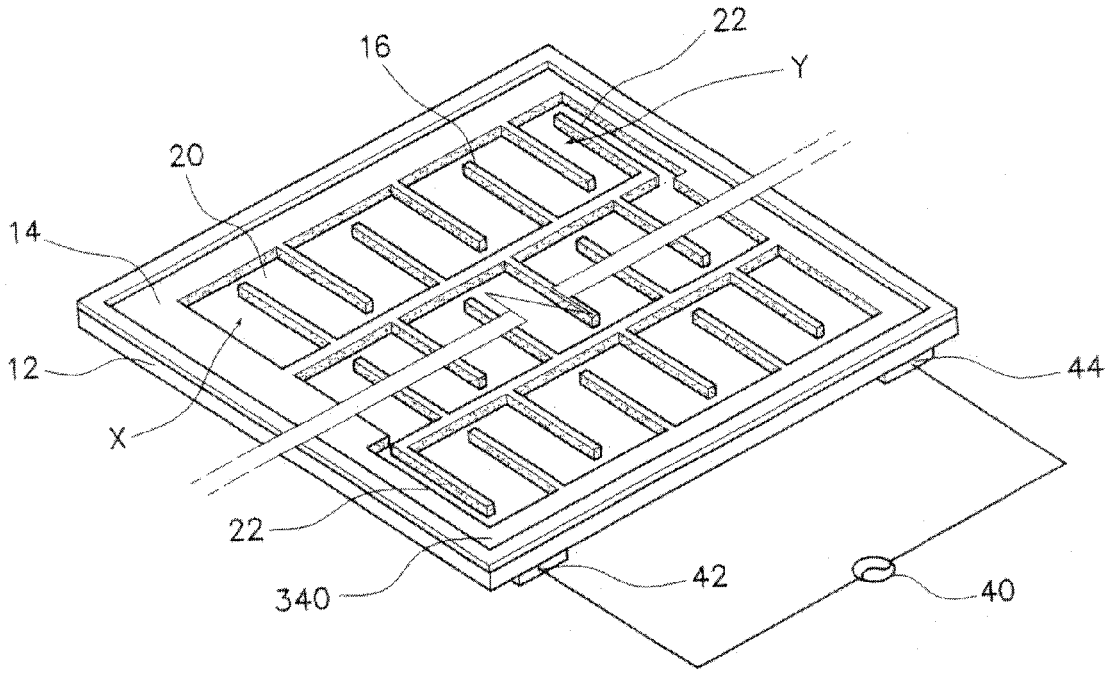
Figure 22:
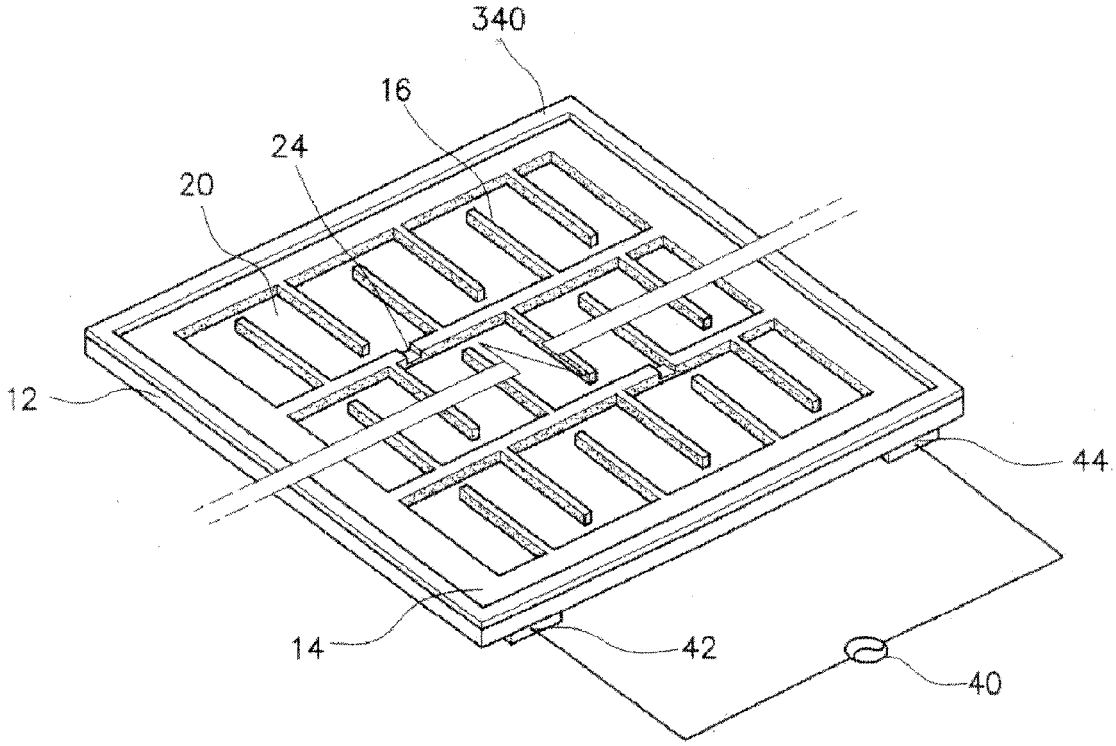

As shown in FIGS. 20, 21 and 22, in case of a structure in which multiple longitudinal discharge channels of serpentine layout consisting of a plurality of discharge lines of a relatively small length connected each other are connected in parallel in a transverse direction, X and Y polarities can be arranged at both upper and lower ends, which is preferable for the smooth arrangement of electrodes regardless of a number of channels.

At this time, the exhaust channels are also variable according to the arrangement of electrodes. Each of the exhaust channels is connected through the electrode space having the same polarity if possible. In a case that the exhaust channels are connected to the electrode space having a different polarity, discharging is not occurred through the main discharge channel of serpentine layout but through the exhaust channels having a smaller length than a relatively long discharge channel of serpentine layout. Thus, it is preferable that the exhaust channels have such a structure in which they are connected to the electrode space having the same polarity in order to prevent a crosstalk.

The embodiments of the discharge channels and exhaust channels are embodiments are embodied in FIGS. 12 to 22.

In the embodiment of FIG. 12, channels for forming electrode spaces are connected to both left and right ends of a discharge channel of serpentine layout having three long channels connected each other, and the channel connected to one end of the discharge channel is utilized as an X electrode space and the channel connected to the other end thereof is utilized as a Y electrode space. The X electrode space is connected to a connecting part and an exhaust channel 22, and an internal electrode 30 is arranged throughout the exhaust channel 22, connecting part and electrode spaces.

Figure 13:
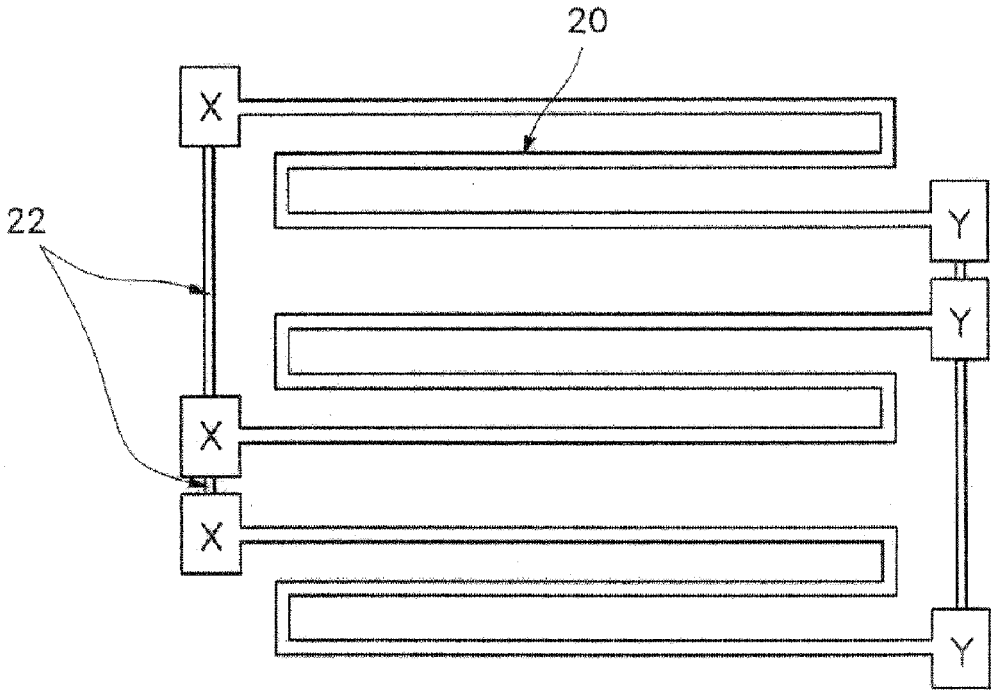

The embodiment of FIG. 13 illustrates an additional exhaust channel 22 formed on the Y electrode space for exhaustion in the embodiment of FIG. 12.

Figure 14:
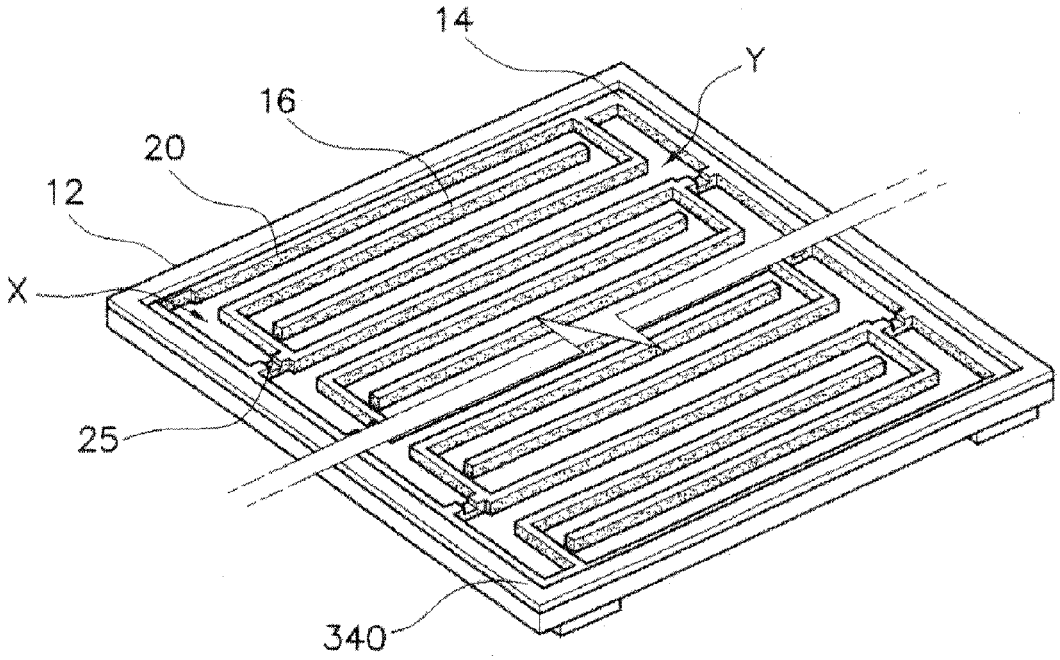

The embodiment of FIG. 14 illustrates the electrodes spaces being used as exhaust lines at both ends of the discharge channel and the connecting part 25 being formed between the electrode spaces.

Figure 15:
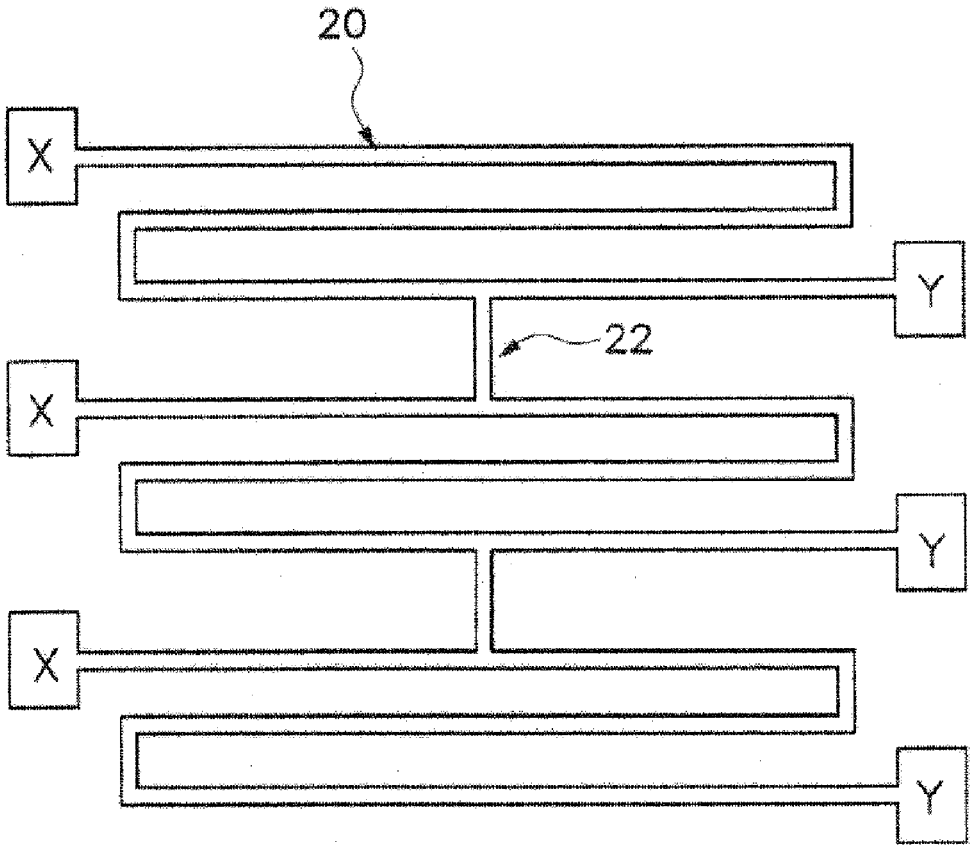

The embodiment of FIG. 15 illustrates the exhaust channel 22 connected to adjacent channels being formed at the middle of the discharge channel 2.

Figure 16:
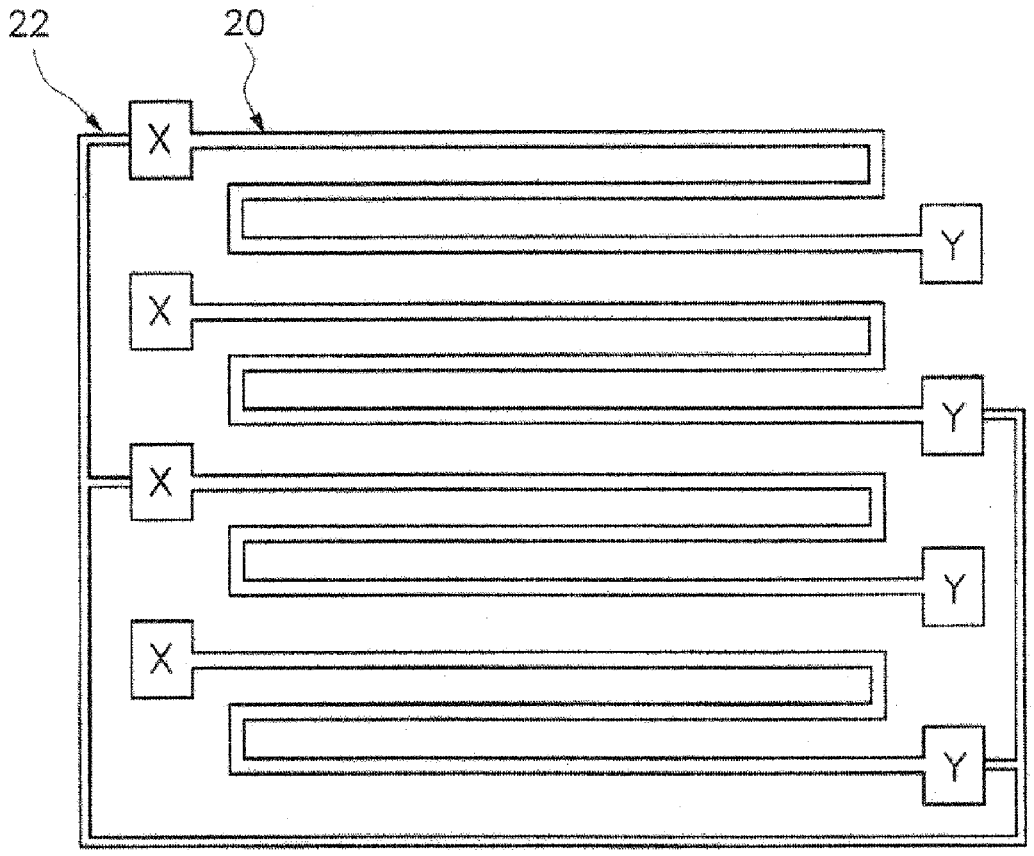

The embodiment of FIG. 16 illustrates the exhaust channel being connected to spaced lines in order to avoid the exhaust channel 22 connected to the discharge channel 20 from being connected to adjacent channels.

The above-described embodiments of FIGS. 12, 13, 14, 15 and 16 illustrate embodiments in which electrode spaces of the same polarity are formed in the same direction.

Figure 17:
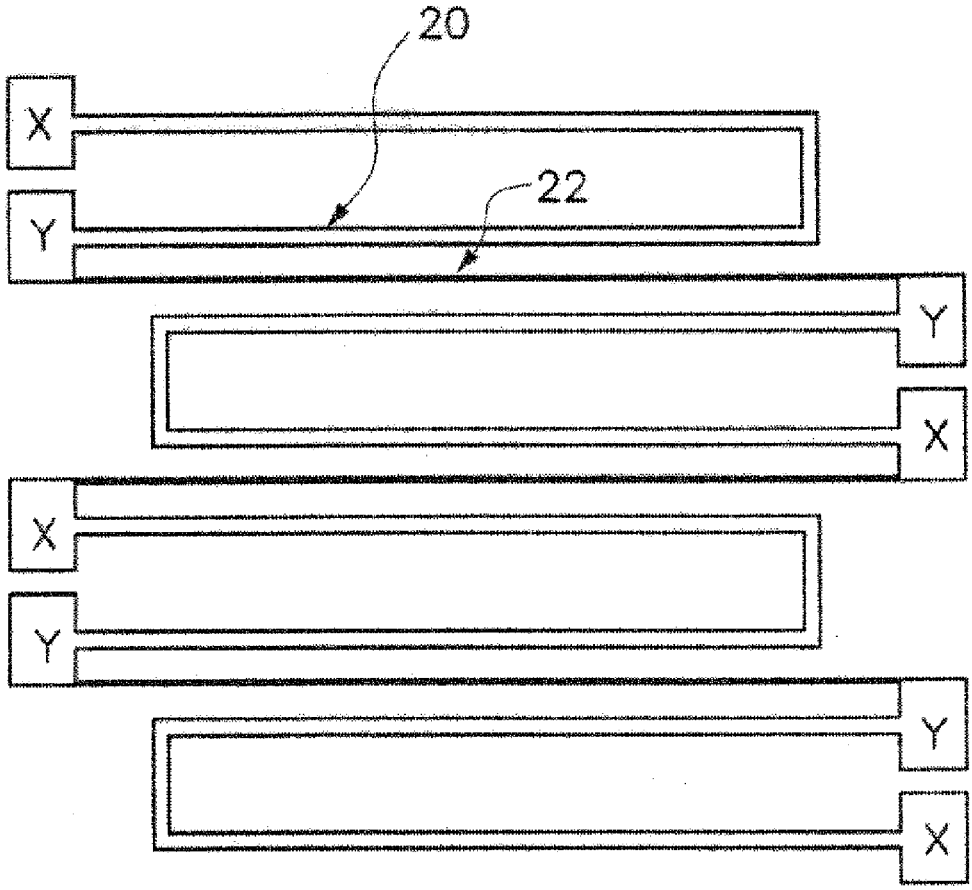
Figure 18:
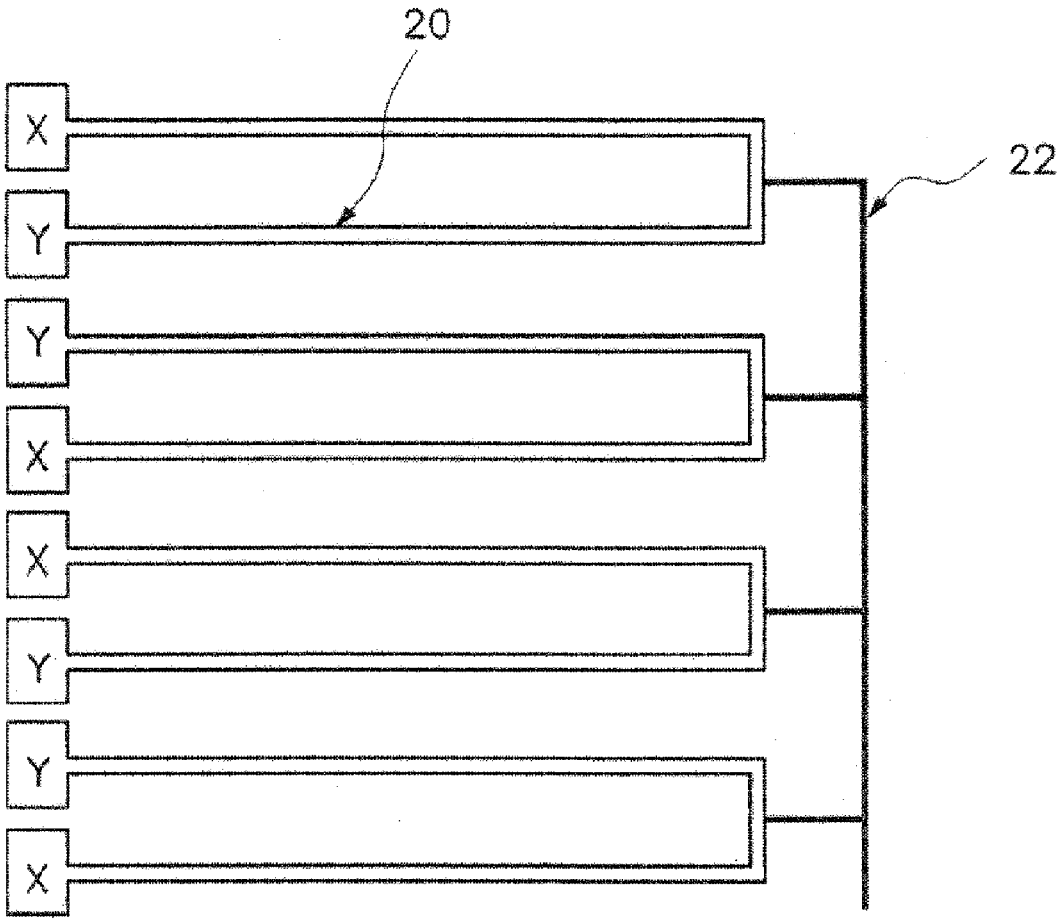
Figure 19:
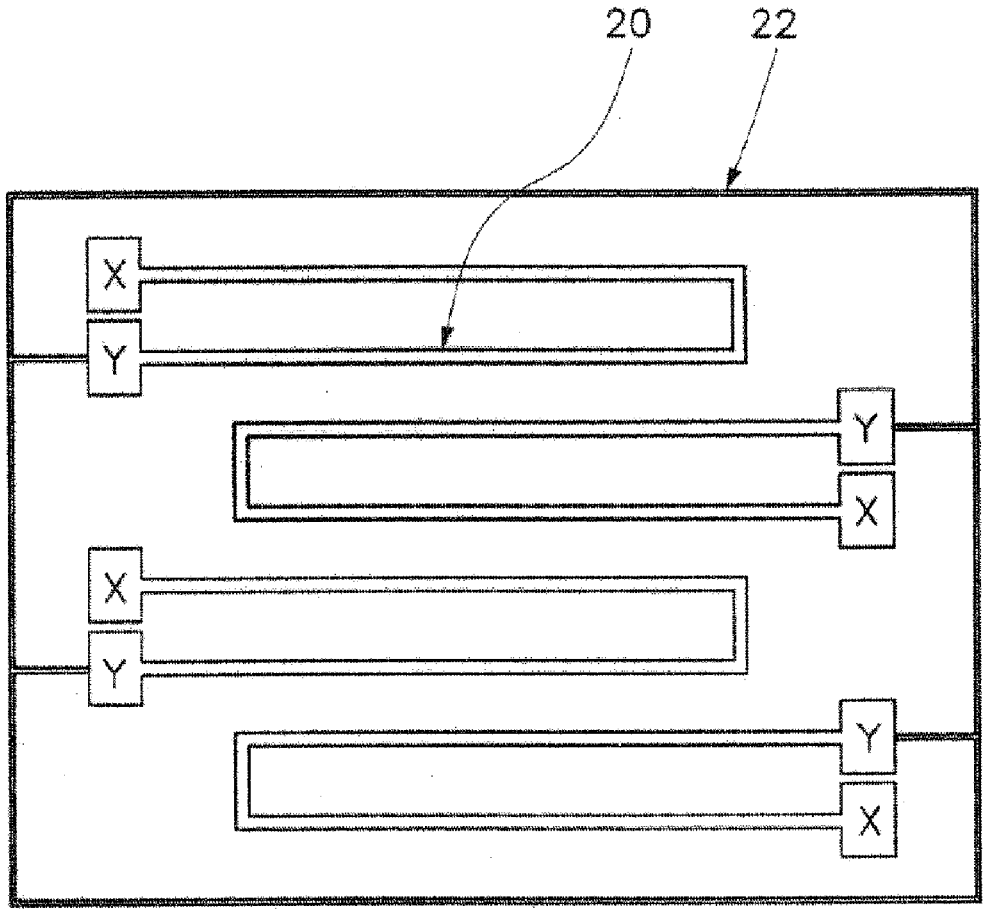

In contrast, FIGS. 17, 18 and 19 are embodiments in which electrode spaces of different polarities are arranged in one direction. In this case, discharge channels of serpentine layout have a "C" shape.

In the embodiment of FIG. 17, electrode spaces are arranged in one direction in the order of X, Y, X and Y, and electrode spaces are arranged in the other direction in the order of Y, X, Y and X. An exhaust channel 22 is formed between the electrode spaces being symmetrical and adjacent to each other and having the same polarity. In other words, an exhaust channel is formed between the discharge channels.

In the embodiment of FIG. 18, electrode spaces are arranged in one direction in the order of X, Y, Y, X, X and Y, and an exhaust channel 22 is formed in the other direction, and respective discharge channels 29 are connected to the exhaust channel 22 by connecting parts.

In the embodiment of FIG. 19, an exhaust channel 22 is formed along side walls 14 of a rear substrate 12, and an exhaust line is formed by connecting electrode spaces of the same polarity by connecting parts.

Meanwhile, in the present invention, discharge channels 20 can be formed as shown in FIGS. 20 and 22 so that longitudinal channels are overlapped and bending portions can be formed on longitudinal ends. The longitudinal channels extending to the ends of the discharge channels 20 are utilized as electrode spaces, and discharge electrodes may be configured on these electrode spaces according to the present invention.

The channels constituting the electrode spaces can be configured so as to be connected to one exhaust channel 22 as shown in FIG. 20.

Further, unlike FIG. 20, the exhaust channel 22 can be formed as shown in FIG. 21 in a manner to be staggered to both opposite ends where discharge electrodes are to be formed. Also, as shown in FIG. 22, the embodiment in which discharge channels are connected by connecting parts 24 without forming any independent exhaust channel is possible. It is obvious that this embodiment can be embodied optionally according to a manufacturer's intention.

As described above, in the flat fluorescent lamp having an exhaust channel, discharge channel and electrode structure in accordance with the present invention, when a power is supplied from an inverter connected to electrodes by a conductor upon driving the lamp, predischarging or auxiliary discharging occurs at electrodes spaces between auxiliary electrodes to form ions or electrons. By such ions or charge previously formed, an overall discharging is generated between main discharge electrodes, i.e., at effective light emitting regions.

Regarding UV rays formed by discharging, in case of using mercury as a pumping source, vacuum UV rays of 254 nm are generated, or in case of using xenon gas, vacuum UV rays of 14 nm, 173 nm, etc. are generated. The vacuum UV rays reach to a fluorescent layer coated on the surfaces of a front substrate and of a rear substrate in discharge channels.

The fluorescent layer generates visible rays as it is converted into a ground state after being pumped by the vacuum UV rays. The visible rays penetrate the front substrate and pass through a diffusion material positioned on the top surface of the lamp to become scattered light. In a case that the visible rays further pass through a prism material, the light having a constant directionality is emitted to the outside.

As seen from above, the flat fluorescent lamp in accordance with the present invention has realized a structure in which multiple discharge channels having a length smaller than conventional discharge channels by connecting a plurality of discharge channels of an independent serpentine layout and an exhaust channel. Therefore, a current density per discharge channel is increased to increase the discharge efficiency and the luminance, thus obtaining a stable flat fluorescent lamp with a large area.

Furthermore, the present invention can maximizes the discharge efficiency obtained from internal electrodes by hybridizing internal electrodes and external electrodes, thereby reducing power consumption.

Furthermore, the internal electrodes of the present invention can be located easily on the center of the cross section of the channel when inserted into the substrates, thereby overcoming the problem of heat damage of panels caused by the electrodes.

Moreover, with the use of auxiliary electrodes of extension and floating types of continuous and discontinuous shapes, a lower firing potential is acquired to thereby achieve a structure suited to a flat fluorescent lamp for a large-scale flat panel display.

In the above description, although the flat fluorescent lamp has been described with the first consideration given to discharge channels, exhaust channels and auxiliary electrodes and other well-known techniques are omitted, it is natural that those skilled in the art may be able to presume and infer them.

Although the present invention has been described with reference to preferred embodiments of a flat fluorescent lamp having a specific shape and structure as shown in the drawings, it should be understood that the embodiments are merely illustrative and those skilled in the art will make a lot of variations, modifications and combinations of the characteristics of the present invention involved with a discharge channel structure, a hybrid electrode, an exhaust channel, an auxiliary electrode shape and an internal electrode structure. Such variations, modifications and combinations are considered as within the scope of this invention.

What is claimed is:

1. A flat fluorescent lamp, comprising:

two substrates;

side walls having a shape corresponding to the edges of the two substrates and forming closed spaces for discharging inside by joining to the two substrates;

partitions formed on at least one surface of the two substrates and forming multiple discharge channels of an independent serpentine layout while separating the two substrates each other; and discharge electrodes arranged on electrode regions formed as channels on both opposite ends of the starting and ending points of the discharge channels of serpentine layout and for discharging the discharge channels in parallel, wherein an exhaust channel is formed independently from the discharge channels and the exhaust channel is connected to the multiple discharge channels of serpentine layout and used for vacuum exhaustion and discharge gas injection.

2. The flat fluorescent lamp of claim 1, wherein the cross sectional area of the exhaust channel or the cross sectional area of the connecting part connecting the exhaust channel to the discharge channels can be configured to be smaller than the cross sectional area of the discharge channels.

3. The flat fluorescent lamp of claim 1, wherein the connecting regions of the discharge channels and the exhaust channel can be formed either at ending portions or at bending portions most adjacent to the electrodes having the same polarity in the multiple discharge channels having a serpentine layout.

4. The flat fluorescent lamp of claim 1, wherein the discharge electrode are composed of external electrodes.

5. The flat fluorescent lamp of claim 1, wherein the discharge electrodes are configured by hybridizing an internal electrode made of metal and an external electrode.

6. The flat fluorescent lamp of claim 5, wherein the internal electrode is configured to form a projecting portion by bending a plate type metal.

7. The flat fluorescent lamp of claim 1, wherein the discharge electrode further includes an auxiliary electrode to be arranged at an outer part of the discharge channels in order to reduce a firing potential.

8. The flat fluorescent lamp of claim 2, wherein the discharge electrode further includes an auxiliary electrode to be arranged at an outer part of the discharge channels in order to reduce a firing potential.

9. The flat fluorescent lamp of claim 5, wherein the discharge electrode further includes an auxiliary electrode to be arranged at an outer part of the discharge channels in order to reduce a firing potential.

10. The flat fluorescent lamp of claim 7, wherein the auxiliary electrode may extend along the discharge channels from the discharge electrode in a continuous line shape or across the discharge channels.

11. The flat fluorescent lamp of claim 7, wherein the auxiliary electrode is configured to be formed along the discharge channels in a discontinuous shape and be in a floating state.

12. The flat fluorescent lamp of claim 7, wherein the auxiliary electrode is formed on the outer surface of the substrates and made of a conductive body of a transparent material.

13. The flat fluorescent lamp of claim 8, wherein the auxiliary electrode is formed on the outer surface of the substrates and made of a conductive body of a transparent material.

14. The flat fluorescent lamp of claim 8, wherein the auxiliary electrode is formed on the outer surface of the substrates and made of a conductive body of a transparent material.

15. The flat fluorescent lamp of claim 8, wherein the auxiliary electrode is formed on the outer surface of the substrates and made of a conductive body of a transparent material.

16. The flat fluorescent lamp of claim 9, wherein the auxiliary electrode is formed on the outer surface of the substrates and made of a conductive body of a transparent material.

17. The flat fluorescent lamp of claim 9, wherein the auxiliary electrode is formed on the outer surface of the substrates and made of a conductive body of a transparent material.

18. The flat fluorescent lamp of claim 9, wherein the auxiliary electrode is formed on the outer surface of the substrates and made of a conductive body of a transparent material.

19. The flat fluorescent lamp of claim 1, wherein discharge electrodes of different polarities are applied to the electrode regions of both opposite ends of the respective discharge channels of serpentine layout, discharge electrodes of the same polarity are arranged in the same direction, and the plurality of electrode regions corresponding to at least one polarity and the exhaust channel can be configured independently from each other and can be connected to the connecting parts.

20. The flat fluorescent lamp of claim 1, wherein discharge electrodes of different polarities are applied to the electrode regions of both opposite ends of the respective discharge channels of serpentine layout, discharge electrodes of the same polarity are arranged in the same direction, and the exhaust channel can be formed by passing through the plurality of electrode regions corresponding to at least one polarity.

21. The flat fluorescent lamp of claim 19, wherein adjacent discharge channels of serpentine layout are formed to have a shape symmetrical to each other.

22. The flat fluorescent lamp of claim 20, wherein adjacent discharge channels of serpentine layout are formed to have a shape symmetrical to each other.

23. The flat fluorescent lamp of claim 1, wherein discharge electrodes of different polarities are applied to the electrode regions of both opposite ends of the respective discharge channels of serpentine layout, the electrode regions connected to the same discharge channel are arranged in the same direction, adjacent discharge channels of serpentine layout have a shape symmetrical to each other, and the exhaust channel can be connected to the electrode regions of the same polarity as they are formed along the side walls.

24. The flat fluorescent lamp of claim 1, wherein discharge electrodes of different polarities are applied to the electrode regions of both opposite ends of the respective discharge channels of serpentine layout, the electrode regions connected to the same discharge channel are arranged in the same direction, adjacent discharge channels of serpentine layout have a shape symmetrical to each other, with the polarities of the electrode regions being symmetrical, and the exhaust channel can be formed between the electrode regions of the same polarity of the discharge channels of serpentine layout.

25. The flat fluorescent lamp of claim 1, wherein discharge electrodes of different polarities are applied to the electrode regions of both opposite ends of the respective discharge channels of serpentine layout, every electrode region is arranged in one direction, the exhaust channel is formed independently in the opposite direction of the arrangement of the electrode regions, and the exhaust channel can be connected to bending end portions of the discharge channels of serpentine layout.

26. The flat fluorescent lamp of claim 1, wherein discharge electrodes of different polarities are applied to the electrode regions of both opposite ends of the respective discharge channels of serpentine layout, every electrode region is arranged in one direction, the exhaust channel is formed independently in the opposite direction of the arrangement of the electrode regions, and the exhaust channel is connected at the middle parts of the final lines of the respective discharge channels of serpentine layout and of the first lines of the subsequent discharge channel of serpentine layout.

27. The flat fluorescent lamp of claim 1, wherein the respective discharge channels can be connected in parallel and driven by using only the internal electrode in the electrode spaces and connecting a capacitive external device to the internal electrode.

28. The flat fluorescent lamp of claim 1, wherein the internal electrode is optionally used in the electrode spaces, a projecting portion can be formed on the internal electrode.

29. The flat fluorescent lamp of claim 28, wherein a bending portion is formed on the projecting portion so that the projecting portion can be located at the center part of the discharge channel.

30. The flat fluorescent lamp of claim 28, wherein the end parts of the projecting portion has a cylindrical shape.

31. The flat fluorescent lamp of claim 29, wherein the end parts of the projecting portion has a cylindrical shape.

32. The flat fluorescent lamp of claim 1, wherein the discharge channels of one independent serpentine layout forms one independent serpentine layout by overlapping discharge spaces in an orthogonal direction between the electrodes of both opposite ends and alternatively forming bending portions on the ends of the discharge spaces, and there is formed a plurality of the discharge channels of the impendent serpentine layout.

* * * * *